US007255751B2

(12) United States Patent
Nishizawa et al.

(10) Patent No.: US 7,255,751 B2
(45) **Date of Patent: *Aug. 14, 2007**

(54) METHOD FOR MANUFACTURING R-T-B SYSTEM RARE EARTH PERMANENT MAGNET

(75) Inventors: Gouichi Nishizawa, Tokyo (JP); Chikara Ishizaka, Tokyo (JP); Tetsuya Hidaka, Tokyo (JP); Akira Fukuno, Tokyo (JP)

(73) Assignee: TDK Corporation, Tokyo (JP)

( * ) Notice: Subject to any disclaimer, the term of this patent is extended or adjusted under 35 U.S.C. 154(b) by 356 days.

This patent is subject to a terminal disclaimer.

(21) Appl. No.: 10/675,797

(22) Filed: Sep. 29, 2003

(65) Prior Publication Data

US 2004/0166013 A1 Aug. 26, 2004

(30) Foreign Application Priority Data

Sep. 30, 2002 (JP) ..... 2002-287033

(51) Int. Cl.
*H01F 1/057* (2006.01)

(52) U.S. Cl. ..... 148/101; 148/103; 148/302

(58) Field of Classification Search ..... None
See application file for complete search history.

(56) References Cited

U.S. PATENT DOCUMENTS 4,836,868 A 6/1989 Yajima et al.
4,895,607 A 1/1990 Yang et al.
5,595,608 A 1/1997 Takebuchi et al.
5,858,123 A 1/1999 Uchida et al.
6,296,720 B1 10/2001 Yamamoto et al.
6,444,048 B1 9/2002 Hasegawa et al.
6,468,365 B1 10/2002 Uchida et al.

(Continued)

FOREIGN PATENT DOCUMENTS

CN 1258082 6/2000

(Continued)

OTHER PUBLICATIONS

Hirosawa, et al., "Effects of CU-NB/ZR Additions on Magnetic Properties of FE3B/(ND-DY)2FE14B Nanocomposite Magnetics", IEEE Transactions on Magnetics, IEEE Inc., New York, U.S., vol. 37, No. 4, part 1, Jul. 2001, pp. 2558-2560.

(Continued)

*Primary Examiner*—John P. Sheehan
(74) *Attorney, Agent, or Firm*—Hogan & Hartson LLP

(57) ABSTRACT

When an R-T-B system rare earth permanent magnet is obtained by a mixing method to obtain a sintered body with a composition consisting essentially of 25% to 35% by weight of R (wherein R represents one or more rare earth elements, providing that the rare earth elements include Y), 0.5% to 4.5% by weight of B, 0.02% to 0.6% by weight of Al and/or Cu, 0.03% to 0.25% by weight of Zr, 4% or less by weight (excluding 0) of Co, and the balance substantially being Fe, wherein a coefficient of variation (CV) showing the dispersion of Zr is 130 or lower, Zr is contained in a low R alloy. This sintered body enables to inhibit the grain growth, while keeping the decrease of magnetic properties to a minimum, and to improve the suitable sintering temperature range.

6 Claims, 17 Drawing Sheets

U.S. PATENT DOCUMENTS

| | | | | |
|---|---|---|---|---|
| 6,506,265 | B2 * | 1/2003 | Yamamoto et al. | 148/302 |
| 2002/0007875 | A1 * | 1/2002 | Yamamoto et al. | 148/302 |
| 2004/0079449 | A1 * | 4/2004 | Kanekiyo et al. | 148/302 |
| 2004/0187962 | A1 * | 9/2004 | Ishizaka et al. | 148/101 |

FOREIGN PATENT DOCUMENTS

| | | | |
|---|---|---|---|
| EP | 0 197 712 | * | 10/1986 |
| EP | 1 014 392 | A2 * | 6/2000 |
| EP | 1 164 599 | | 12/2001 |
| EP | 1 164 599 | A2 * | 12/2001 |
| JP | 01-219143 | | 9/1989 |
| JP | 10-041113 | | 2/1998 |
| JP | 10-259459 | | 9/1998 |
| JP | 2000-234151 | | 8/2000 |
| JP | 2002-075717 | | 3/2002 |

OTHER PUBLICATIONS

McGuiness, et al., "Magnetic Properties and Microstructure in NdDyFeBZr-HDDR", Journal of Magnetism and Magnetic Materials, Elsevier Science Publishers, Amsterdam, NL, vol. 188, No. 1-2, Sep. 15, 1998, pp. 119-124.

Kim, et al., "Microstructure of ZR Containing NDFEB", IEEE Transactions On Magnetics, IEEE Inc., New York, U.S., vol. 33, No. 5, Part 2, Sep. 1997, pp. 3823-3825.

* cited by examiner

FIG. 1

| | | |
|---|---|---|
| ALLOY a1 | LOW R ALLOY | 23.6Nd−6Pr−0.3Dy−1.1B−0.05Cu−0.2Al−bal.Fe(wt. %) |
| ALLOY a2 | LOW R ALLOY CONTAINING Zr | 23.6Nd−6Pr−0.3Dy−1.1B−0.05Cu−0.2Al−0.32Zr−bal.Fe(wt. %) |
| ALLOY a3 | LOW R ALLOY CONTAINING Zr | 15.7Nd−6Pr−8.1Dy−1.1B−0.05Cu−0.2Al−0.15Zr−bal.Fe(wt. %) |
| ALLOY a4 | LOW R ALLOY CONTAINING Zr | 23.9Nd−6Pr−1.1B−0.05Cu−0.2Al−0.15Zr−bal.Fe(wt. %) |
| ALLOY a5 | LOW R ALLOY CONTAINING Zr (WITH HIGH Al) | 23 .6Nd−6Pr−0.3Dy−1.1B−0.05Cu−0.42Al−0.12Zr−bal.Fe(wt. %) |
| ALLOY a6 | LOW R ALLOY CONTAINING Zr (WITHOUT Al) | 23 .6Nd−6Pr−0.3Dy−1.1B−0.05Cu−0.12Zr−bal.Fe(wt. %) |
| ALLOY a7 | LOW R ALLOY CONTAINING Zr | 27.9Nd−0.1Dy−1.1B−0.03Cu−0.05Al−0.08Zr−bal.Fe(wt. %) |
| ALLOY a8 | LOW R ALLOY CONTAINING Zr | 23.7Nd−6Pr−0.2Dy−1.6B−0.3Cu−0.25Al−0.3Zr−bal.Fe(wt. %) |
| ALLOY b1 | HIGH R ALLOY (WITHOUT B) | 40.6Nd−0.05Cu−5Co−0.2Al−bal.Fe(wt. %) |
| ALLOY b2 | HIGH R ALLOY CONTAINING Zr (WITH B) | 40.6Nd−0.5B−0.05Cu−5Co−0.2Al−3.1Zr−bal.Fe(wt. %) |
| ALLOY b3 | HIGH R ALLOY (WITHOUT B AND Al) | 40.6Nd−0.05Cu−5Co−bal.Fe(wt. %) |
| ALLOY b4 | HIGH R ALLOY (WITHOUT B) | 35.1Nd−0.03Cu−2Co−0.05Al−bal.Fe(wt. %) |
| ALLOY b5 | HIGH R ALLOY (WITHOUT B) | 40.6Nd−0.3Cu−20Co−0.25Al−bal.Fe(wt. %) |

FIG. 2

| No. | COMPOSITIONS OF SINTERED BODIES(wt. %) | AMOUNT OF OXYGEN (ppm) | LOW R ALLOYS | HIGH R ALLOYS | SINTERING TEMPERA-TURE | Br (kG) | HcJ (kOe) | Hk/HcJ (%) | Br+0.1 × HcJ | CV VALUE |
|---|---|---|---|---|---|---|---|---|---|---|
| 1 | Fe-24.9Nd-5.4Pr-0.4Dy-1B-0.05Cu-0.2Al-0.5Co | 1210 | ALLOY a1 | ALLOY b1 | 1070°C | 13.91 | 12.59 | 38 | 15.17 | - |
| 2 | Fe-24.9Nd-5.4Pr-0.4Dy-1B-0.05Cu-0.2Al-0.5Co-0.01Zr | 1290 | ALLOY a1 + ALLOY a2 | ALLOY b1 | | 13.94 | 13.28 | 57 | 15.27 | 68 |
| 3 | Fe-24.9Nd-5.4Pr-0.4Dy-1B-0.05Cu-0.2Al-0.5Co-0.02Zr | 1160 | | | | 13.95 | 13.29 | 79 | 15.28 | 70 |
| 4 | Fe-24.9Nd-5.4Pr-0.4Dy-1B-0.05Cu-0.2Al-0.5Co-0.03Zr | 1360 | | | | 13.96 | 13.34 | 96 | 15.29 | 66 |
| 5 | Fe-24.9Nd-5.4Pr-0.4Dy-1B-0.05Cu-0.2Al-0.5Co-0.05Zr | 1090 | | | | 13.96 | 13.33 | 96 | 15.29 | 72 |
| 6 | Fe-24.9Nd-5.4Pr-0.4Dy-1B-0.05Cu-0.2Al-0.5Co-0.10Zr | 1190 | | | | 13.97 | 13.31 | 96 | 15.30 | 78 |
| 7 | Fe-24.9Nd-5.4Pr-0.4Dy-1B-0.05Cu-0.2Al-0.5Co-0.20Zr | 1110 | | | | 13.99 | 13.64 | 97 | 15.35 | 101 |
| 8 | Fe-24.9Nd-5.4Pr-0.4Dy-1B-0.05Cu-0.2Al-0.5Co-0.25Zr | 1320 | | | | 13.94 | 13.75 | 97 | 15.32 | 99 |
| 9 | Fe-24.9Nd-5.4Pr-0.4Dy-1B-0.05Cu-0.2Al-0.5Co-0.30Zr | 1240 | | | | 13.85 | 13.85 | 98 | 15.24 | 110 |
| 10 | Fe-24.8Nd-5.5Pr-0.3Dy-1B-0.05Cu-0.2Al-0.5Co-0.05Zr | 1350 | ALLOY a1 | ALLOY b1 + ALLOY b2 | | 13.89 | 13.32 | 63 | 15.22 | 159 |
| 11 | Fe-24.8Nd-5.5Pr-0.3Dy-1B-0.05Cu-0.2Al-0.5Co-0.10Zr | 1400 | | | | 13.84 | 13.43 | 95 | 15.18 | 214 |
| 12 | Fe-24.8Nd-5.5Pr-0.3Dy-1B-0.05Cu-0.2Al-0.5Co-0.20Zr | 1170 | | | | 13.78 | 13.56 | 97 | 15.14 | 257 |
| 13 | Fe-24.8Nd-5.5Pr-0.3Dy-1B-0.05Cu-0.2Al-0.5Co-0.25Zr | 1220 | | | | 13.71 | 13.71 | 98 | 15.08 | 281 |
| 14 | Fe-24.8Nd-5.5Pr-0.3Dy-1B-0.05Cu-0.2Al-0.5Co-0.30Zr | 1310 | | | | 13.62 | 13.88 | 98 | 15.01 | 275 |
| 15 | Fe-24.9Nd-5.4Pr-0.4Dy-1B-0.05Cu-0.2Al-0.5Co | 1888 | ALLOY a1 | ALLOY b1 | | 13.89 | 11.44 | 54 | 15.03 | - |
| 16 | Fe-24.9Nd-5.4Pr-0.4Dy-1B-0.05Cu-0.2Al-0.5Co-0.10Zr | 1820 | ALLOY a1 + ALLOY a2 | ALLOY b1 | | 13.97 | 12.33 | 97 | 15.20 | 81 |
| 17 | Fe-24.9Nd-5.4Pr-0.4Dy-1B-0.05Cu-0.2Al-0.5Co-0.20Zr | 1920 | | | | 13.98 | 12.58 | 97 | 15.24 | 98 |
| 18 | Fe-24.9Nd-5.4Pr-0.4Dy-1B-0.05Cu-0.2Al-0.5Co-0.25Zr | 1870 | | | | 13.93 | 12.81 | 98 | 15.21 | 97 |
| 19 | Fe-24.8Nd-5.5Pr-0.3Dy-1B-0.05Cu-0.2Al-0.5Co-0.10Zr | 1800 | ALLOY a1 | ALLOY b1 + ALLOY b2 | | 13.81 | 12.39 | 96 | 15.05 | 223 |
| 20 | Fe-24.8Nd-5.5Pr-0.3Dy-1B-0.05Cu-0.2Al-0.5Co-0.20Zr | 1960 | | | | 13.75 | 12.55 | 97 | 15.01 | 263 |

FIG. 3

| No. | COMPOSITIONS OF SINTERED BODIES(wt. %) | AMOUNT OF OXYGEN (ppm) | LOW R ALLOYS | HIGH R ALLOYS | SINTERING TEMPERA-TURE | Br (kG) | HcJ (kOe) | Hk/HcJ (%) | Br+0.1 × HcJ |
|---|---|---|---|---|---|---|---|---|---|
| 21 | Fe-24.9Nd-5.4Pr-0.4Dy-1B-0.05Cu-0.2Al-0.5Co | 1210 | ALLOY a1 | ALLOY b1 | 1050°C | 13.94 | 13.24 | 86 | 15.26 |
| 22 | Fe-24.9Nd-5.4Pr-0.4Dy-1B-0.05Cu-0.2Al-0.5Co-0.01Zr | 1260 | ALLOY a1 + ALLOY a2 | ALLOY b1 | | 13.94 | 13.23 | 91 | 15.26 |
| 23 | Fe-24.9Nd-5.4Pr-0.4Dy-1B-0.05Cu-0.2Al-0.5Co-0.02Zr | 1180 | | | | 13.95 | 13.19 | 94 | 15.27 |
| 24 | Fe-24.9Nd-5.4Pr-0.4Dy-1B-0.05Cu-0.2Al-0.5Co-0.03Zr | 1360 | | | | 13.94 | 13.19 | 94 | 15.26 |
| 25 | Fe-24.9Nd-5.4Pr-0.4Dy-1B-0.05Cu-0.2Al-0.5Co-0.05Zr | 1110 | | | | 13.94 | 13.23 | 95 | 15.26 |
| 26 | Fe-24.9Nd-5.4Pr-0.4Dy-1B-0.05Cu-0.2Al-0.5Co-0.10Zr | 1170 | | | | 13.94 | 13.28 | 95 | 15.27 |
| 27 | Fe-24.9Nd-5.4Pr-0.4Dy-1B-0.05Cu-0.2Al-0.5Co-0.20Zr | 1200 | | | | 13.91 | 13.55 | 95 | 15.27 |
| 28 | Fe-25.0Nd-5.4Pr-0.3Dy-1B-0.05Cu-0.2Al-0.5Co-0.05Zr | 1300 | ALLOY a1 | ALLOY b1 + ALLOY b2 | | 13.88 | 12.96 | 96 | 15.18 |
| 29 | Fe-24.8Nd-5.5Pr-0.3Dy-1B-0.05Cu-0.2Al-0.5Co-0.10Zr | 1370 | | | | 13.85 | 12.76 | 97 | 15.13 |
| 30 | Fe-24.8Nd-5.5Pr-0.3Dy-1B-0.05Cu-0.2Al-0.5Co-0.20Zr | 1250 | | | | 13.68 | 12.58 | 98 | 14.94 |
| 31 | Fe-24.9Nd-5.4Pr-0.4Dy-1B-0.05Cu-0.01Al-0.5Co-0.10Zr | 1220 | ALLOY a5 + ALLOY a6 | ALLOY b1 + ALLOY b3 | | 14.15 | 11.20 | 95 | 15.27 |
| 32 | Fe-24.9Nd-5.4Pr-0.4Dy-1B-0.05Cu-0.03Al-0.5Co-0.10Zr | 1310 | | | | 14.14 | 12.49 | 96 | 15.39 |
| 33 | Fe-24.9Nd-5.4Pr-0.4Dy-1B-0.05Cu-0.05Al-0.5Co-0.10Zr | 1140 | | | | 14.13 | 12.60 | 95 | 15.39 |
| 34 | Fe-24.9Nd-5.4Pr-0.4Dy-1B-0.05Cu-0.3Al-0.5Co-0.10Zr | 1180 | | | | 13.87 | 13.27 | 97 | 15.20 |
| 35 | Fe-24.9Nd-5.4Pr-0.4Dy-1B-0.05Cu-0.4Al-0.5Co-0.10Zr | 1230 | | | | 13.61 | 13.00 | 96 | 14.91 |

FIG. 9

| No. | COMPOSITIONS OF SINTERED BODIES (wt. %) | AMOUNT OF OXYGEN (ppm) | SINTERING TEMPERATURE | Br (kG) | HcJ (kOe) | Hk/HcJ (%) | Br+0.1 × HcJ | CV VALUE |
|---|---|---|---|---|---|---|---|---|
| 36 | Fe-24.9Nd-5.4Pr-0.4Dy-1B-0.05Cu-0.2Al-0.5Co | 680 | 1010°C | 14.03 | 11.68 | 87 | 15.20 | - |
| 37 | | | 1030°C | 14.05 | 13.92 | 88 | 15.44 | - |
| 38 | | | 1050°C | 14.13 | 12.64 | 29 | 15.39 | - |
| 39 | | | 1060°C | 14.08 | 5.53 | 22 | 14.63 | - |
| 40 | Fe-24.9Nd-5.4Pr-0.4Dy-1B-0.05Cu-0.2Al-0.5Co-0.05Zr | 670 | 1010°C | 14.00 | 12.84 | 90 | 15.29 | - |
| 41 | | | 1030°C | 14.03 | 14.17 | 92 | 15.44 | - |
| 42 | | | 1050°C | 14.09 | 14.37 | 90 | 15.53 | - |
| 43 | | | 1060°C | 14.04 | 14.00 | 53 | 15.44 | - |
| 44 | Fe-24.9Nd-5.4Pr-0.4Dy-1B-0.05Cu-0.2Al-0.5Co-0.08Zr | 870 | 1010°C | 14.06 | 12.76 | 91 | 15.33 | - |
| 45 | | | 1030°C | 14.05 | 14.61 | 90 | 15.51 | - |
| 46 | | | 1040°C | 14.16 | 14.59 | 94 | 15.62 | - |
| 47 | | | 1050°C | 14.14 | 14.61 | 95 | 15.60 | - |
| 48 | | | 1060°C | 14.16 | 14.60 | 95 | 15.62 | - |
| 49 | | | 1070°C | 14.17 | 14.60 | 93 | 15.63 | - |
| 50 | | | 1090°C | 14.18 | 13.51 | 44 | 15.53 | - |
| 51 | Fe-24.9Nd-5.4Pr-0.4Dy-1B-0.05Cu-0.2Al-0.5Co-0.11Zr | 700 | 1010°C | 14.03 | 12.85 | 88 | 15.31 | 65 |
| 52 | | | 1030°C | 14.10 | 14.67 | 92 | 15.57 | 71 |
| 53 | | | 1040°C | 14.13 | 14.66 | 95 | 15.59 | 77 |
| 54 | | | 1050°C | 14.15 | 14.71 | 95 | 15.62 | 75 |
| 55 | | | 1060°C | 14.15 | 14.69 | 97 | 15.62 | 72 |
| 56 | | | 1070°C | 14.09 | 14.61 | 97 | 15.55 | 75 |
| 57 | | | 1090°C | 14.08 | 14.49 | 97 | 15.53 | 81 |
| 58 | | | 1150°C | 14.01 | 0.11 | 14 | 14.02 | 142 |
| 59 | Fe-24.9Nd-5.4Pr-0.4Dy-1B-0.05Cu-0.2Al-0.5Co-0.15Zr | 740 | 1010°C | 14.04 | 12.85 | 86 | 15.32 | 68 |
| 60 | | | 1030°C | 14.13 | 14.72 | 93 | 15.60 | 75 |
| 61 | | | 1040°C | 14.09 | 14.77 | 95 | 15.57 | 72 |
| 62 | | | 1050°C | 14.14 | 14.79 | 95 | 15.62 | 80 |
| 63 | | | 1060°C | 14.14 | 14.72 | 97 | 15.61 | 85 |
| 64 | | | 1070°C | 14.07 | 14.66 | 99 | 15.53 | 88 |
| 65 | | | 1090°C | 14.02 | 14.51 | 99 | 15.47 | 91 |
| 66 | | | 1150°C | 14.00 | 0.50 | 27 | 14.05 | 150 |
| 67 | Fe-24.9Nd-5.4Pr-0.4Dy-1B-0.05Cu-0.2Al-0.5Co-0.18Zr | 810 | 1010°C | 13.98 | 12.81 | 87 | 15.26 | - |
| 68 | | | 1030°C | 14.07 | 14.67 | 93 | 15.54 | - |
| 69 | | | 1040°C | 14.13 | 14.60 | 95 | 15.61 | - |
| 70 | | | 1050°C | 14.05 | 14.72 | 96 | 15.52 | - |
| 71 | | | 1060°C | 14.18 | 14.78 | 97 | 15.65 | - |
| 72 | | | 1070°C | 14.03 | 14.76 | 98 | 15.51 | - |
| 73 | | | 1090°C | 14.08 | 14.63 | 98 | 15.54 | - |
| 74 | | | 1100°C | 14.01 | 14.45 | 98 | 15.46 | - |
| 75 | | | 1150°C | 14.04 | 1.75 | 41 | 14.22 | - |

FIG. 11
No. 37 1030°C Zr-free
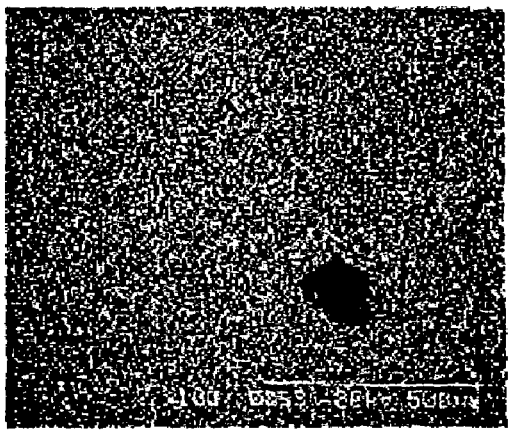
No. 39 1060°C Zr-free
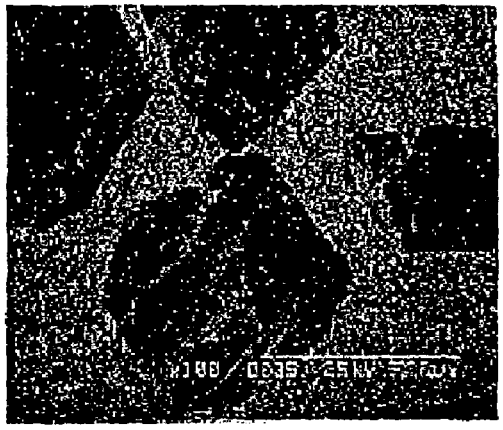
No. 43 1060°C 0.05%Zr
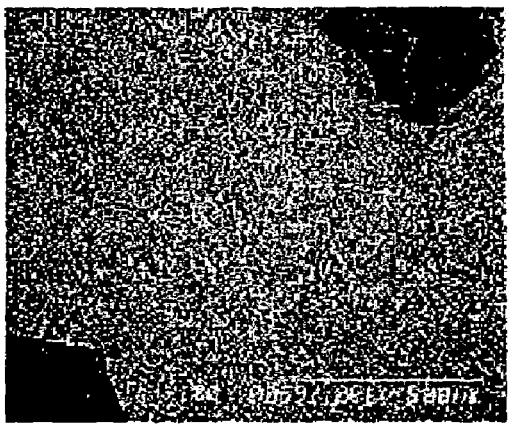
No. 48 1060°C 0.08Zr
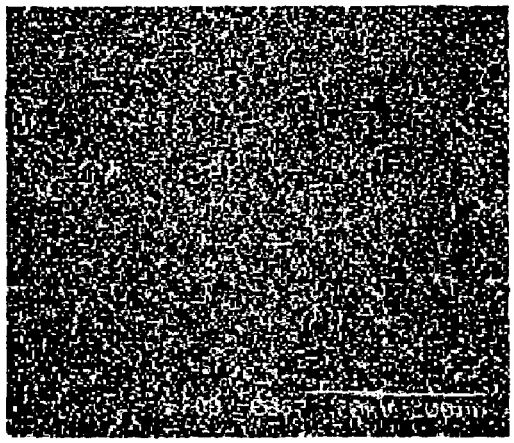

FIG. 17

| No. | COMPOSITIONS OF SINTERED BODIES(wt. %) | LOW R ALLOYS | HIGH R ALLOYS | SINTERING TEMPERA-TURE | Br (kG) | HcJ (kOe) | Hk/HcJ (%) | Br+0.1 × HcJ |
|---|---|---|---|---|---|---|---|---|
| 76 | Fe-25.0Nd-5.3Pr-1B-0.05Cu-0.2Al-0.5Co-0.13Zr | ALLOY a4 | ALLOY b1 | 1060°C | 14.42 | 12.62 | 98 | 15.68 |
| 77 | Fe-23.2Nd-5.4Pr-2.1Dy-1B-0.05Cu-0.2Al-0.5Co-0.13Zr | ALLOY a1 + ALLOY a2 + ALLOY a3 | | 1070°C | 13.68 | 17.3 | 97 | 15.41 |
| 78 | Fe-20.6Nd-5.4Pr-4.7Dy-1B-0.05Cu-0.2Al-0.5Co-0.13Zr | | | | 13.19 | 23.23 | 98 | 15.51 |
| 79 | Fe-19.0Nd-5.3Pr-7.2Dy-1B-0.05Cu-0.2Al-0.5Co-0.13Zr | | | 1090°C | 12.37 | 30.51 | 94 | 15.42 |

FIG. 18

| No. | COMPOSITIONS OF SINTERED BODIES(wt. %) | AMOUNT OF OXYGEN (ppm) | LOW R ALLOYS | HIGH R ALLOYS | SINTERING TEMPERA-TURE | Br (kG) | HcJ (kOe) | Hk/HcJ (%) | Br+0.1 × HcJ | CV VALUE |
|---|---|---|---|---|---|---|---|---|---|---|
| 80 | Fe-28.3Nd-0.1Dy-1B-0.03Cu-0.05Al-0.2Co-0.07Zr | 720 | ALLOY a7 | ALLOY b4 | 1070°C | 14.62 | 13.1 | 98 | 15.93 | 77 |
| 81 | Fe-26.9Nd-4.8Pr-0.2Dy-1.3B-0.3Cu-0.25Al-4Co-0.24Zr | 980 | ALLOY a8 | ALLOY b5 | 1020°C | 13.88 | 15.3 | 96 | 15.41 | 98 |

METHOD FOR MANUFACTURING R-T-B SYSTEM RARE EARTH PERMANENT MAGNET

BACKGROUND OF THE INVENTION

1. Field of the Invention

The present invention relates to a method for manufacturing an R-T-B system rare earth permanent magnet containing, as main components, R (wherein R represents one or more rare earth elements, providing that the rare earth elements include Y), T (wherein T represents at least one transition metal element essentially containing Fe, or Fe and Co), and B (boron).

2. Description of the Related Art

Among rare earth permanent magnets, an R-T-B system rare earth permanent magnet has been increasingly demanded year by year for the reasons that its magnetic properties are excellent and that its main component Nd is abundant as a source and relatively inexpensive.

Research and development directed towards the improvement of the magnetic properties of the R-T-B system rare earth permanent magnet have intensively progressed. For example, Japanese Patent Laid-Open No. 1-219143 discloses that the addition of 0.02 to 0.5 at % of Cu improves magnetic properties of the R-T-B system rare earth permanent magnet as well as heat treatment conditions. However, the method described in Japanese Patent Laid-Open No. 1-219143 is insufficient to obtain high magnetic properties required of a high performance magnet, such as a high coercive force (HcJ) and a high residual magnetic flux density (Br).

The magnetic properties of an R-T-B system rare earth permanent magnet obtained by sintering depend on the sintering temperature. On the other hand, it is difficult to equalize the heating temperature throughout all parts of a sintering furnace in the scale of industrial manufacturing. Thus, the R-T-B system rare earth permanent magnet is required to obtain desired magnetic properties even when the sintering temperature is changed. A temperature range in which desired magnetic properties can be obtained is referred to as a suitable sintering temperature range herein.

In order to obtain a higher-performance R-T-B system rare earth permanent magnet, it is necessary to decrease the amount of oxygen contained in alloys. However, if the amount of oxygen contained in the alloys is decreased, abnormal grain growth is likely to occur in a sintering process, resulting in a decrease in a squareness. This is because oxides formed by oxygen contained in the alloys inhibit the grain growth.

Thus, a method of adding a new element to the R-T-B system rare earth permanent magnet containing Cu has been studied as means for improving the magnetic properties. Japanese Patent Laid-Open No. 2000-234151 discloses the addition of Zr and/or Cr to obtain a high coercive force and a high residual magnetic flux density.

Likewise, Japanese Patent Laid-Open No. 2002-75717 discloses a method of uniformly dispersing a fine ZrB compound, NbB compound or HfB compound (hereinafter referred to as an M-B compound) into an R-T-B system rare earth permanent magnet containing Zr, Nb or Hf as well as Co, Al and Cu, followed by precipitation, so as to inhibit the grain growth in a sintering process and to improve magnetic properties and a suitable sintering temperature range.

According to Japanese Patent Laid-Open No. 2002-75717, the suitable sintering temperature range is extended by the dispersion and precipitation of the M-B compound.

However, in Example 3-1 described in the above publication, the suitable sintering temperature range is narrow, such as approximately 20° C. Accordingly, to obtain high magnetic properties using a mass-production furnace or the like, it is desired to further extend the suitable sintering temperature range. Moreover, in order to obtain a sufficiently wide suitable sintering temperature range, it is effective to increase the additive amount of Zr. However, as the additive amount of Zr increases, the residual magnetic flux density decreases, and thus, high magnetic properties of interest cannot be obtained.

DISCLOSURE OF THE INVENTION

Hence, it is an object of the present invention to provide a method for manufacturing an R-T-B system rare earth permanent magnet, which enables to inhibit the grain growth, while keeping a decrease in magnetic properties to a minimum, and also enables to further improve the suitable sintering temperature range.

In recent years, a high-performance R-T-B system rare earth permanent magnet has been manufactured mainly by a mixing method, which comprises mixing various types of metallic powders or alloy powders having different compositions, and sintering the obtained mixture. In this mixing method, alloys for formation of a main phase, which contain as a main constituent an $R_2T_{14}B$ system intermetallic compound (wherein R represents one or more rare earth elements, providing that the rare earth elements include Y, and T represents at least one transition metal element containing, as a main constituent, Fe, or Fe and Co), are typically mixed with alloys for formation of a grain boundary phase located between the main phases (hereinafter referred to as "alloys for formation of a grain boundary phase). Since the alloys for formation of a main phase contain a relatively low amount of R, compared with a composition of sintered magnet, they are called low R alloys at times. On the other hand, since the alloys for formation of a grain boundary phase contain a relatively high amount of R, compared with a composition of the sintered magnet, they are called high R alloys at times.

The present inventors confirmed that when an R-T-B system rare earth permanent magnet is obtained by the mixing method, if Zr is contained in the low R alloys, the dispersion of Zr becomes high in the obtained R-T-B system rare earth permanent magnet. The high dispersion of Zr enables the prevention of the abnormal grain growth with a lower content of Zr, and also enables the extension of the suitable sintering temperature range.

The present invention is made based on the above findings, and it relates to a method for manufacturing an R-T-B system rare earth permanent magnet comprising a sintered body with a composition consisting essentially of 25% to 35% by weight of R (wherein R represents one or more rare earth elements, (providing that the rare earth elements include Y), 0.5% to 4.5% by weight of B, 0.02% to 0.6% by weight of Al and/or Cu, 0.03% to 0.25% by weight of Zr, 4% or less by weight (excluding 0) of Co, and the balance substantially being Fe, the above manufacturing method comprising the steps of manufacturing a compacted body containing a low R alloy containing a $R_2T_{14}B$ compound as a main constituent and Zr, and a high R alloy containing as main constituents R and T, and then sintering the compacted body.

In this manufacturing method, the low R alloy desirably contains Cu and/or Al as well as Zr. This is because the inclusion of Cu and/or Al is effective for improving the dispersion of Zr in the low R alloy.

As described above, according to the R-T-B system rare earth permanent magnet of the present invention, the suitable sintering temperature range is improved. The effect to improve the suitable sintering temperature range is provided by a compound for magnet in a state of powders (or a compacted body thereof) before sintered. Accordingly, the suitable sintering temperature range, where the R-T-B system rare earth permanent magnet obtained by sintering has squareness (Hk/HcJ) of 90% or more, is 40° C. or more for the compacted body of the present invention.

The content of Zr is preferably between 0.05% and 0.2% by weight, and more preferably between 0.1% and 0.15% by weight in the R-T-B system rare earth permanent magnet of the present invention.

Moreover, other than Zr, the R-T-B system rare earth permanent magnet of the present invention preferably has a composition consisting essentially of 28% to 33% by weight of R, 0.5% to 1.5% by weight of B, 0.3% or less by weight (excluding 0) of Al, 0.3% or less by weight (excluding 0) of Cu, 0.1% to 2.0% by weight of Co, and the balance substantially being Fe. More preferably, it has a composition consisting of 29% to 32% by weight of R, 0.8% to 1.2% by weight of B, 0.25% or less by weight (excluding 0) of Al, 0.15% or less by weight (excluding 0) of Cu, and the balance substantially being Fe.

Furthermore, the effects obtained by adding Zr to a low R alloy, such as the improvement of the dispersion of Zr and the extension of the suitable sintering temperature range, become significant under low-oxygen conditions, such as when the amount of oxygen contained in a sintered body is 2,000 ppm or less.

BRIEF DESCRIPTION OF THE DRAWINGS

FIG. 1 is a table showing the chemical compositions of low R alloys and high R alloys used in Example 1;

FIG. 2 is a table showing the composition, the amount of oxygen, and the magnetic properties of each of the permanent magnets (Nos. 1 to 20) obtained in Example 1;

FIG. 3 is a table showing the composition, the amount of oxygen, and the magnetic properties of each of the permanent magnets (Nos. 21 to 35) obtained in Example 1;

FIG. 9 is a table showing the composition, the amount of oxygen, and the magnetic properties of each of the permanent magnets (Nos. 36 to 75) obtained in Example 2;

FIGS. 11 is a set of photographs obtained by observing, by SEM (Scanning Electron Microscope), the microstructure in the section of each of the permanent magnets Nos. 37, 39, 43 and 48 obtained in Example 2;

FIG. 17 is a table showing the composition, the amount of oxygen, and the magnetic properties of each of the permanent magnets (Nos. 76 to 79) obtained in Example 3;

FIG. 18 is a table showing the composition, the amount of oxygen, and the magnetic properties of each of the permanent magnets (Nos. 80 and 81) obtained in Example 4.

DETAILED DESCRIPTION OF THE PREFERRED EMBODIMENTS

Figure 4:
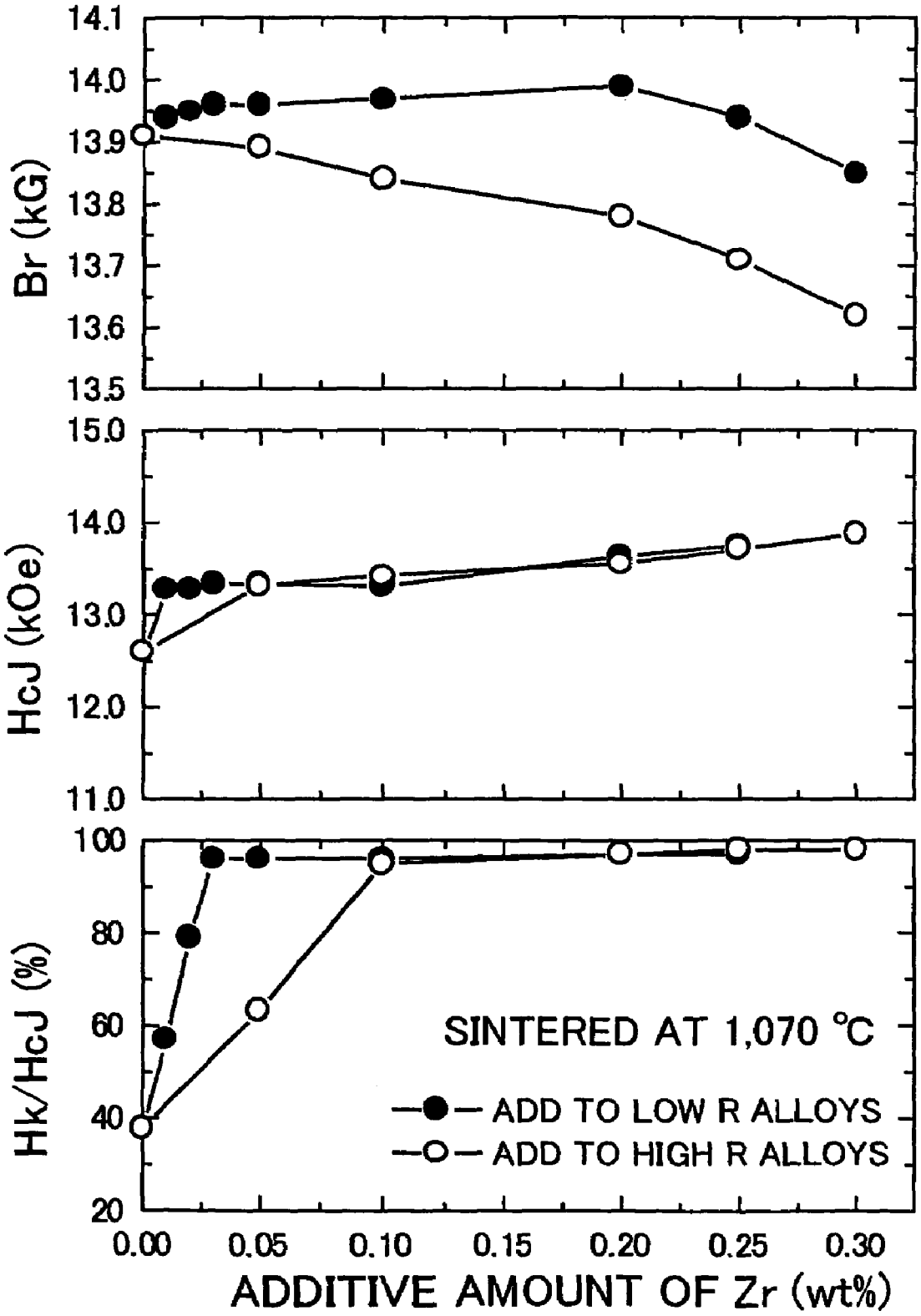
FIG. 4 is a set of graphs showing the relationship between each of the residual magnetic flux density (Br), coercive force (HcJ) and squareness (Hk/HcJ), and the additive amount of Zr in the permanent magnets (sintering temperature: 1,070° C.) obtained in Example 1.

The embodiments of the present invention will be described below.

<Microstructure>

First, the microstructure of the R-T-B system rare earth permanent magnet that is a feature of the present invention will be explained.

The feature of the present invention is that Zr is uniformly dispersed in the microstructure of a sintered body. More specifically, the feature is specified by a coefficient of variation (referred to as a CV (coefficient of variation) value in the specification of the present application). In the present invention, the CV value of Zr is 130 or less, preferably 100 or less, and more preferably 90 or less. The smaller the CV value, the higher the dispersion of Zr that can be obtained. As is well known, the CV value is a value (percentage) obtained by dividing a standard deviation by an arithmetic mean value. In addition, the CV value in the present invention is obtained under measurement conditions in Examples described later.

Thus, the high dispersion of Zr results from a method of adding Zr. As described later, the R-T-B system rare earth permanent magnet of the present invention can be manufactured by a mixing method. The mixing method comprises mixing low R alloys for formation of a main phase with high R alloys for formation of a grain boundary phase. Comparing with the case of adding Zr to the high R alloys, the dispersion is significantly improved when Zr is added to the low R alloys.

Since the dispersion of Zr is high in the R-T-B system rare earth permanent magnet of the present invention, the R-T-B system rare earth permanent magnet is able to exert the effect to inhibit the grain growth even with the addition of a smaller amount of Zr.

Next, it was confirmed for the R-T-B system rare earth permanent magnet of the present invention that (1) a Zr rich region is also rich in Cu, (2) a Zr rich region is rich in both Cu and Co, or (3) a Zr rich region is rich all in Cu, Co and Nd. In particular, it is highly probable that the region is rich in both Zr and Cu. Thus, Zr coexists with Cu, thereby exerting its effect. Moreover, all Nd, Co and Cu are elements that form a grain boundary phase. Accordingly, from the fact that the region is rich in Zr, it is determined that Zr exists in the grain boundary phase.

The reason why Zr has the above described relationship with Cu, Co and Nd is uncertain, but the following assumption can be made.

According to the present invention, a liquid phase that is rich both in one or more of Cu, Nd and Co, and in Zr (hereinafter referred to as "Zr rich liquid phase") is generated in a sintering process. In terms of wetting property to $R_2T_{14}B_1$ crystal grains (compound), this Zr rich liquid phase differs from a liquid phase in a common system that does not contain Zr. This becomes a factor for slowing the speed of grain growth in the sintering process. Accordingly, the Zr rich liquid phase can inhibit the grain growth and prevent the occurrence of abnormal grain growth. At the same time, the Zr rich liquid phase enables to improve the suitable sintering temperature range, and thereby it becomes possible to easily manufacture an R-T-B system rare earth permanent magnet with high magnetic properties.

By forming a grain boundary phase that is rich both in one or more of Cu, Nd and Co, and in Zr, the above described effects can be obtained. Accordingly, Zr can be dispersed more uniformly and finely than when it is present in a solid state (oxide, boride, etc.) in the sintering process. Thus, the required additive amount of Zr can be reduced, and further, a large amount of different phase that decreases the ratio of a main phase is not generated. Accordingly, it is assumed that the decrease of magnetic properties such as a residual magnetic flux density (Br) does not take place.

<Chemical Composition>

Next, a desired composition of the R-T-B system rare earth permanent magnet of the present invention will be explained. The term chemical composition is used herein to mean a chemical composition obtained after sintering. As described later, the R-T-B system rare earth permanent magnet of the present invention can be manufactured by a mixing method. Each of the low R alloys and the high R alloys will be explained in the description of the manufacturing method.

The rare earth permanent magnet of the present invention contains 25% to 35% by weight of R.

The term R is used herein to mean one or more rare earth elements selected from a group consisting of La, Ce, Pr, Nd, Sm, Eu, Gd, Tb, Dy, Ho, Er, Yb, Lu and Y. If the amount of R is less than 25% by weight, an $R_2T_{14}B_1$ phase as a main phase of the rare earth permanent magnet is not sufficiently generated. Accordingly, α-Fe or the like having soft magnetism is deposited and the coercive force significantly decreases. On the other hand, if the amount of R exceeds 35% by weight, the volume ratio of the $R_2T_{14}B_1$ phase as a main phase decreases, and the residual magnetic flux density decreases. Moreover, if the amount of R exceeds 35% by weight, R reacts with oxygen, and the content of oxygen thereby increases. In accordance with the increase of the oxygen content, an R rich phase effective for the generation of coercive force decreases, resulting in a reduction in the coercive force. Therefore, the amount of R is set between 25% and 35% by weight. The amount of R is preferably between 28% and 33% by weight, and more preferably between 29% and 32% by weight.

Since Nd is abundant as a source and relatively inexpensive, it is preferable to use Nd as a main component of R. Moreover, since the containment of Dy increases an anisotropic magnetic field, it is effective to contain Dy to improve the coercive force. Accordingly, it is desired to select Nd and Dy for R and to set the total amount of Nd and Dy between 25% and 33% by weight. In addition, in the above range, the amount of Dy is preferably between 0.1% and 8% by weight. It is desired that the amount of Dy is arbitrarily determined within the above range, depending on which is more important, a residual magnetic flux density or a coercive force. This is to say, when a high residual magnetic flux density is required to be obtained, the amount of Dy is preferably set between 0.1% and 3.5% by weight. When a high coercive force is required to be obtained, it is preferably set between 3.5% and 8% by weight.

Moreover, the rare earth permanent magnet of the present invention contains 0.5% to 4.5% by weight of boron (B). If the amount of B is less than 0.5% by weight, a high coercive force cannot be obtained. However, if the amount of B exceeds 4.5% by weight, the residual magnetic flux density is likely to decrease. Accordingly, the upper limit is set at 4.5% by weight. The amount of B is preferably between 0.5% and 1.5% by weight, and more preferably between 0.8% and 1.2% by weight.

The R-T-B system rare earth permanent magnet of the present invention may contain Al and/or Cu within the range between 0.02% and 0.6% by weight. The containment of Al and/or Cu within the above range can impart a high coercive force, a strong corrosion resistance, and an improved temperature stability of magnetic properties to the obtained permanent magnet. When Al is added, the additive amount of Al is preferably between 0.03% and 0.3% by weight, and more preferably between 0.05% and 0.25% by weight. When Cu is added, the additive amount of Cu is 0.3% or less by weight (excluding 0), preferably 0.15% or less by weight (excluding 0), and more preferably between 0.03% and 0.08% by weight.

The R-T-B system rare earth permanent magnet of the present invention contains 0.03% to 0.25% by weight of Zr. When the content of oxygen is reduced to improve the magnetic properties of the R-T-B system rare earth permanent magnet, Zr exerts the effect of inhibiting the abnormal grain growth in a sintering process and thereby makes the microstructure of the sintered body uniform and fine. Accordingly, when the amount of oxygen is low, Zr fully exerts its effect. The amount of Zr is preferably between 0.05% and 0.2% by weight, and more preferably between 0.1% and 0.15% by weight.

The R-T-B system rare earth permanent magnet of the present invention contains 2,000 ppm or less oxygen. If it contains a large amount of oxygen, an oxide phase that is a non-magnetic component increases, thereby decreasing magnetic properties. Thus, in the present invention, the amount of oxygen contained in a sintered body is set at 2,000 ppm or less, preferably 1,500 ppm or less, and more preferably 1,000 ppm or less. However, when the amount of oxygen is simply decreased, an oxide phase having a grain growth inhibiting effect decreases, so that the grain growth easily occurs in a process of obtaining full density increase during sintering. Thus, in the present invention, the R-T-B system rare earth permanent magnet to contains a certain amount of Zr, which exerts the effect of inhibiting the abnormal grain growth in a sintering process.

The R-T-B system rare earth permanent magnet of the present invention contains Co in an amount of 4% or less by weight (excluding 0), preferably between 0.1% and 2.0% by weight, and more preferably between 0.3% and 1.0% by weight. Co forms a phase similar to that of Fe. Co has an effect to improve Curie temperature and the corrosion resistance of a grain boundary phase.

<Manufacturing Method>

Next, desired embodiments of the method for manufacturing an R-T-B system rare earth permanent magnet of the present invention will be explained.

In the present invention, an R-T-B system rare earth permanent magnet is manufactured using alloys (low R alloys) containing an $R_2T_{14}B$ phase as a main phase and other alloys (high R alloys) containing a higher amount of R than the low R alloys.

A raw material is first subjected to strip casting in a vacuum or an inert gas atmosphere, or preferably an Ar atmosphere, so that low R alloys and high R alloys are obtained. Examples of a raw material to be used may include rare earth metals, rare earth alloys, pure iron, ferroboron, and their alloys. When solidification and segregation are observed in the obtained starting mother alloys, the alloys are subjected to a solution treatment, as necessary. As conditions for the treatment, the starting mother alloys may be kept within a temperature range between 700° C. and 1,500° C. in a vacuum or Ar atmosphere for 1 hour or longer.

The characteristic matter of the present invention is that Zr is added to the low R alloys. As described in the above chapter <Microstructure>, the dispersion of Zr in a sintered body can be improved by adding Zr to the low R alloys.

The low R alloys can contain Cu and/or Al as well as R, T and B. When the low R alloys contain the above components, they constitute R—Cu—Al—Zr—T (Fe)—B system alloys. On the other hand, the high R alloys can contain one or more of Cu, Co and Al as well as R, T (Fe) and B. When the high R alloys contain the above components, they constitute R—Cu—Co—Al—T (Fe—Co)—B system alloys.

After preparing the low R alloys and the high R alloys, these master alloys are crushed separately or together. The crushing step comprises a crushing process and a pulverizing process. First, each of the master alloys is crushed to a particle size of approximately several hundreds of μm. The crushing is preferably carried out in an inert gas atmosphere, using a stamp mill, a jaw crusher, a brown mill, etc. In order to improve rough crushability, it is effective to carry out crushing after the absorption of hydrogen. Otherwise, it is also possible to release hydrogen after absorbing it and then carry out crushing.

After carrying out the crushing, the routine proceeds to a pulverizing process. In the pulverizing process, a jet mill is mainly used, and crushed powders with a particle size of approximately several hundreds of μm are pulverized to a mean particle size between 3 and 5 μm. The jet mill is a method comprising releasing a high-pressure inert gas (e.g., nitrogen gas) from a narrow nozzle so as to generate a high-speed gas flow, accelerating the crushed powders with the high-speed gas flow, and making crushed powders hit against each other, the target, or the wall of the container, so as to pulverize the powders.

When the low R alloys and the high R alloys are pulverized separately in the pulverizing process, the pulverized low R alloy powders are mixed with the pulverized high R alloys powders in a nitrogen atmosphere. The mixing ratio of the low R alloy powders and the high R alloy powders may be approximately between 80:20 and 97:3 at a weight ratio. Likely, in a case where the low R alloys are pulverized together with the high R alloys, the mixing ratio may be approximately between 80:20 and 97:3 at a weight ratio. When approximately 0.01% to 0.3% by weight of additive agents such as zinc stearate is added during the pulverizing process, fine powders which are oriented well, can be obtained during compacting.

Subsequently, mixed powders comprising of the low R alloy powders and the high R alloy powders are filled in a tooling equipped with electromagnets, and they are compacted in a magnet field, in a state where their crystallographic axis is oriented by applying a magnetic field. This compacting may be carried out by applying a pressure of approximately 0.7 to 1.5 t/cm$^2$ in a magnetic field of 12.0 to 17.0 kOe.

After the mixed powders are compacted in the magnetic field, the compacted body is sintered in a vacuum or an inert gas atmosphere. The sintering temperature needs to be adjusted depending on various conditions such as a composition, a crushing method, the difference between particle size and particle size distribution, but the sintering may be carried out at 1,000° C. to 1,100° C. for about 1 to 5 hours.

After completion of the sintering, the obtained sintered body may be subjected to an aging treatment. The aging treatment is important for the control of a coercive force. When the aging treatment is carried out in two steps, it is effective to retain the sintered body for a certain time at around 800° C. and around 600° C. When a heat treatment is carried out at around 800° C. after completion of the sintering, the coercive force increases. Accordingly, it is particularly effective in the mixing method. Moreover, when a heat treatment is carried out at around 600° C., the coercive force significantly increases. Accordingly, when the aging treatment is carried out in a single step, it is appropriate to carry out it at around 600° C.

The rare earth permanent magnet of the present invention, which has the above composition and is manufactured by the above manufacturing method, can have high magnetic properties regarding a residual magnetic flux density (Br) and a coercive force (HcJ), such that Br+0.1×HcJ is 15.2 or more, and further, 15.4 or more.

EXAMPLES

The present invention will be further described in the following Examples. The R-T-B system rare earth permanent magnet of the present invention will be explained in the following Examples 1 to 4. However, since the prepared alloys and each manufacturing process are considerably common in all the Examples, first, these common points will be explained.

(1) Mother Alloys

Thirteen types of alloys shown in FIG. 1 were prepared by the strip casting method.

(2) Hydrogen Crushing Process

A hydrogen crushing treatment was carried out, in which after hydrogen was absorbed at room temperature, dehydrogenation was carried out thereon at 600° C. for 1 hour in an Ar atmosphere.

To control the amount of oxygen contained in a sintered body to 2,000 ppm or less, so as to obtain high magnetic properties, in the present experiments, the atmosphere was controlled at an oxygen concentration less than 100 ppm throughout processes, from a hydrogen treatment (recovery after a crushing process) to sintering (input into a sintering furnace). Hereinafter, this process is referred to as an "oxygen-free process."

(3) Crushing Step

Generally, two-step crushing is carried out, which includes crushing process and pulverizing process. However, since the crushing process could not be carried out in an oxygen-free process, the crushing process was omitted in the present Examples.

Additive agents are mixed before carrying out the pulverizing process. The type of additive agents is not particularly limited, and those contributing to the improvement of crushability and the improvement of orientation during compacting may be appropriately selected. In the present examples, 0.05% to 0.1% zinc stearate was mixed. The mixing of additive agents may be carried out, for example, for 5 to 30 minutes, using a Nauta Mixer or the like.

Thereafter, the alloy powders were subjected to pulverizing process to a mean particle size of approximately 3 to 6 μm using a jet mill. In the present experiments, there were used two types of pulverized powders, having a mean particle size of either 4 μm or 5 μm.

Needless to say, both the additive agent mixing process and the pulverizing process were carried out in an oxygen-free process.

(4) Mixing Process

In order to efficiently carry out the experiments, in some cases, several types of pulverized powders are prepared and mixed, so that the resultant product has a desired composition (especially regarding the amount of Zr). Even in these cases, the mixing of additive agents may be carried out, for example, for 5 to 30 minutes, using a Nauta Mixer or the like.

The process is preferably carried out in an oxygen-free process. However, in a case where the content of oxygen in a sintered body is somewhat increased, the amount of oxygen contained in fine powders used for compacting is adjusted in this mixing process. For example, fine powders having the same composition and the same mean particle size were prepared, and the powders were then left in a 100 ppm or more oxygen-containing atmosphere for several minutes to several hours, so as to obtain fine powders containing several thousands of ppm oxygen. These two types of fine powders are mixed in an oxygen-free process to adjust the amount of oxygen. In Example 1, each permanent magnet was manufactured by the above described method.

(5) Compacting Process

The obtained fine powders are compacted in a magnetic field. More specifically, the fine powders were filled in a tooling equipped with electromagnets, and they are compacted in a magnet field, in a state where their crystallographic axis is oriented by applying a magnetic field. This compacting may be carried out by applying a pressure of approximately 0.7 to 1.5 t/cm$^2$ in a magnetic field of 12.0 to 17.0 kOe. In the present experiments, the compacting was carried out by applying a pressure of 1.2 t/cm$^2$ in a magnetic field of 15 kOe, so as to obtain a compacted body. The present process was also carried out in an oxygen-free process.

(6) Sintering and Aging Processes

The obtained compacted body was sintered at 1,010° C. to 1,150° C. for 4 hours in a vacuum atmosphere, followed by quenching. Thereafter, the obtained sintered body was subjected to a two-step aging treatment consisting of treatments of 800° C.×1 hour and 550° C.×2.5 hours (both in an Ar atmosphere).

Example 1

Alloys shown in FIG. 1 were mixed, so as to obtain the compositions of sintered bodies shown in FIGS. 2 and 3. Thereafter, the obtained products were subjected to a hydrogen crushing treatment and then pulverized using a jet mill to a mean particle size of 5.0 μm. The types of the used alloys are also described in FIGS. 2 and 3. Thereafter, the fine powders were compacted in a magnetic field, and then sintered at 1,050° C. or 1,070° C. The obtained sintered bodies were subjected to a two-step aging treatment.

Figure 5:
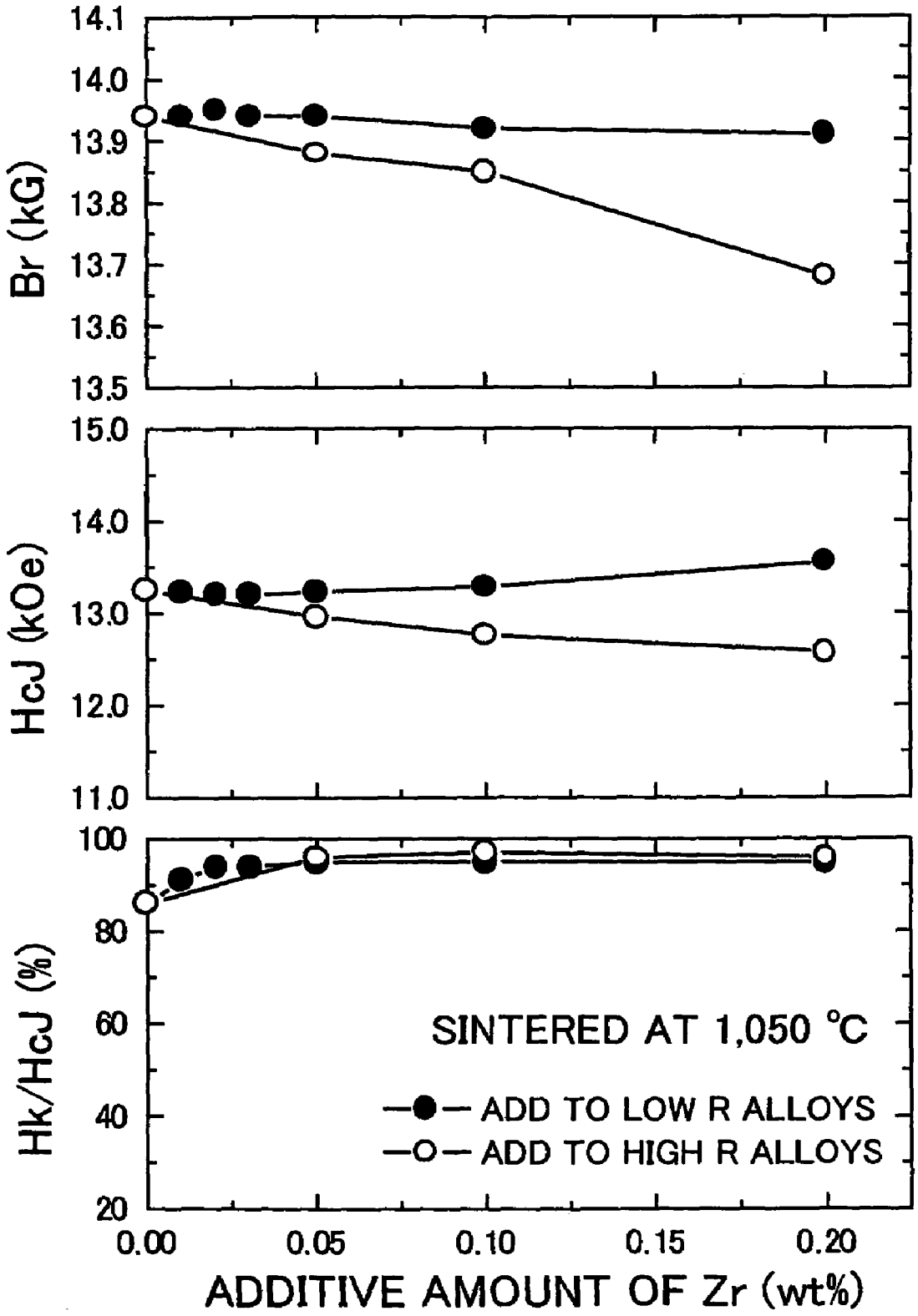
FIG. 5 is a set of graphs showing the relationship between each of the residual magnetic flux density (Br), coercive force (HcJ) and squareness (Hk/HcJ), and the additive amount of Zr in the permanent magnets (sintering temperature: 1,050° C.) obtained in Example 1.

The obtained R-T-B system rare earth permanent magnets were measured with a B-H tracer in terms of their residual magnetic flux density (Br), coercive force (HcJ) and squareness (Hk/HcJ). It should be noted that Hk means an external magnetic field strength obtained when the magnetic flux density becomes 90% of the residual magnetic flux density in the second quadrant of a magnetic hysteresis loop. The results are shown in FIGS. 2 and 3. FIG. 4 is a set of graphs showing the relationship between the additive amount of Zr and magnetic properties at a sintering temperature of 1,070° C., and FIG. 5 is a set of graphs showing the relationship between the additive amount of Zr and magnetic properties at a sintering temperature of 1,050° C. In addition, the results of measurement of the content of oxygen in the sintered bodies are shown in FIGS. 2 and 3. In FIG. 2, the permanent magnets Nos. 1 to 14 contain oxygen within the range between 1,000 and 1,500 ppm. In the same figure, the permanent magnets Nos. 15 to 20 contain oxygen within the range between 1,500 and 2,000 ppm. In FIG. 3, all of the permanent magnets Nos. 21 to 35 contain oxygen within the range between 1,000 and 1,500 ppm.

In FIG. 2, the permanent magnet No. 1 does not contain Zr. The permanent magnets Nos. 2 to 9 contain Zr, which is added to low R alloys thereof. The permanent magnets Nos. 10 to 14 contain Zr, which is added to high R alloys thereof. In the graphs shown in FIG. 4, permanent magnets containing Zr added to low R alloys thereof are described as "add to low R alloys," and permanent magnets containing Zr added to high R alloys thereof are described as "add to high R alloys." It is noted that FIG. 4 refers to permanent magnets containing such a small amount of oxygen as 1,000 to 1,500 ppm as shown in FIG. 2.

From FIGS. 2 and 4, it can be seen that the permanent magnet No. 1 that contains no Zr and was sintered at 1,070° C. had a low level of coercive force (HcJ) and squareness (Hk/HcJ). The microstructure of this permanent magnet was observed, and it was confirmed that coarse crystal grains were generated as a result of the abnormal grain growth.

Figure 6:
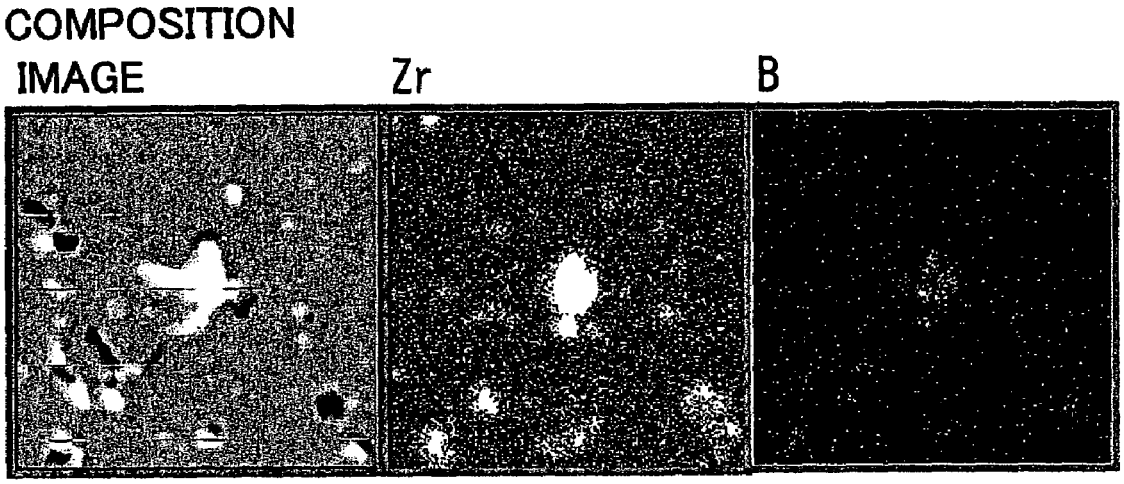
FIG. 6 is a photograph showing the EPMA (Electron Probe Micro Analyzer) element mapping results of the permanent magnets (with the addition of Zr to the high R alloys) in Example 1.

In order that a permanent magnet obtained by addition of Zr to high R alloys thereof has 95% or more squareness (Hk/HcJ), 0.1% Zr needs to be added thereto. In permanent magnets obtained by adding Zr in an amount smaller than the above, the abnormal grain growth was observed. Moreover, as shown in FIG. 6 for example, element mapping observation was carried out using EPMA (Electron Prove Micro Analyzer), and as a result, B and Zr were observed in the same position. Accordingly, it is assumed that a ZrB compound was formed. When the additive amount of Zr is increased to 0.2%, as shown in FIGS. 2 and 4, the decrease of the residual magnetic flux density (Br) becomes non-negligible.

Figure 7:
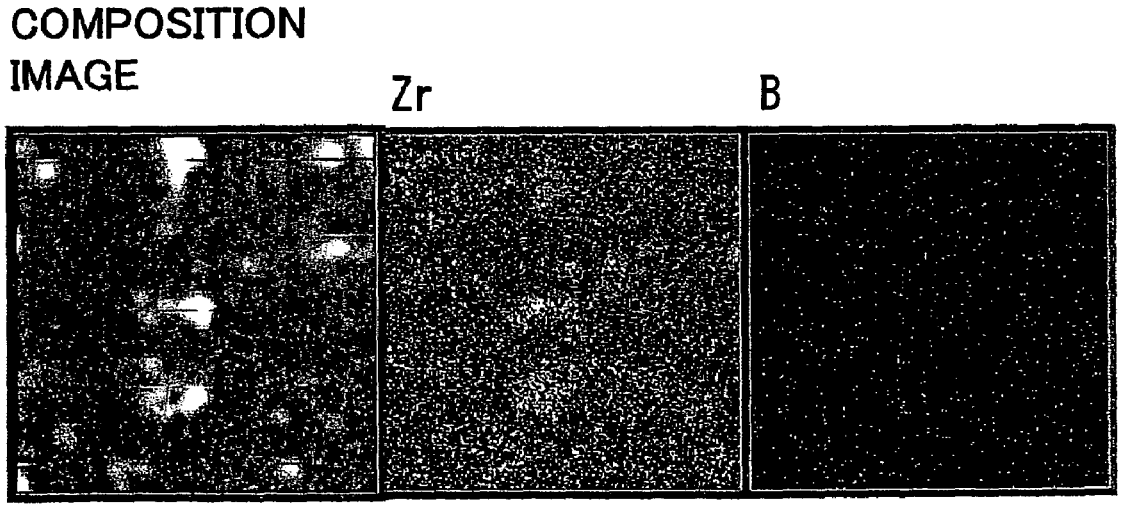
FIG. 7 is a photograph showing the EPMA element mapping results of the permanent magnets (with the addition of Zr to the low R alloys) in Example 1.

In contrast, in the case of adding Zr to low R alloys thereof, the obtained permanent magnet could have 95% or more squareness (Hk/HcJ) by addition of 0.03% Zr. When the microstructure was observed, abnormal grain growth was not found. Moreover, even when more than 0.03% Zr was added, the residual-magnetic flux density (Br) and the coercive force (HcJ) did not decrease. Accordingly, when a permanent magnet is manufactured by adding Zr to low R alloys thereof, high magnetic properties can be obtained, even though it is manufactured under conditions such as sintering in a higher temperature range, a reduction in particle size after pulverizing, and a low oxygen atmosphere. However, even in the case of the permanent magnet manufactured by adding Zr to low R alloys thereof, if the additive amount of Zr is increased to 0.3% by weight, the residual magnetic flux density (Br) becomes smaller than that of the permanent magnet containing no Zr. Thus, even in the case of addition to the low R alloys, the additive amount of Zr is preferably 0.25% or less by weight. As in the case of the permanent magnet obtained by addition of Zr to high R alloys thereof, the permanent magnet obtained by addition of Zr to low R alloys thereof was subjected to element mapping observation with EPMA. As a result, as shown in FIG. 7 for example, B and Zr were not observed in the same position.

Focusing attention on the relationship between the amount of oxygen and magnetic properties, it is found from FIGS. 2 and 3 that high magnetic properties can be obtained by reducing the amount of oxygen to 2,000 ppm or less. In FIG. 2, by comparing the permanent magnets Nos. 6 to 8 with the permanent magnet Nos. 16 to 18, and by comparing Nos. 11 and 12 with Nos. 19 and 20, it is found that when the amount of oxygen is reduced to 1,500 ppm or less, the coercive force (HcJ) favorably increases.

From FIGS. 3 and 5, it is found that the permanent magnet No. 21 containing no Zr has a low squareness (Hk/HcJ) of 86%, even when the sintering temperature is 1,050° C. The abnormal grain growth was observed also in the microstructure of this permanent magnet.

In the case of the permanent magnets (Nos. 28 to 30) obtained by addition of Zr to high R alloys thereof, the squareness (Hk/HcJ) is improved by addition of Zr, but as the additive amount of Zr is increased, the residual magnetic flux density (Br) greatly decreases.

In contrast, in the case of the permanent magnets (Nos. 22 to 27) obtained by addition of Zr to low R alloys thereof, the squareness (Hk/HcJ) is improved, and at the same time, the residual magnetic flux density (Br) hardly decreases.

In the permanent magnets Nos. 31 to 35 in FIG. 3, the amount of Al is changed. Considering the magnetic properties of these permanent magnets, it is found that the coercive force (HcJ) is improved by increasing the amount of Al.

The value of Br+0.1×HcJ is described in FIGS. 2 and 3. It is found that the value of each of the permanent magnets obtained by adding Zr to low R alloys thereof is 15.2 or greater, regardless of the additive amount of Zr.

Figure 8:
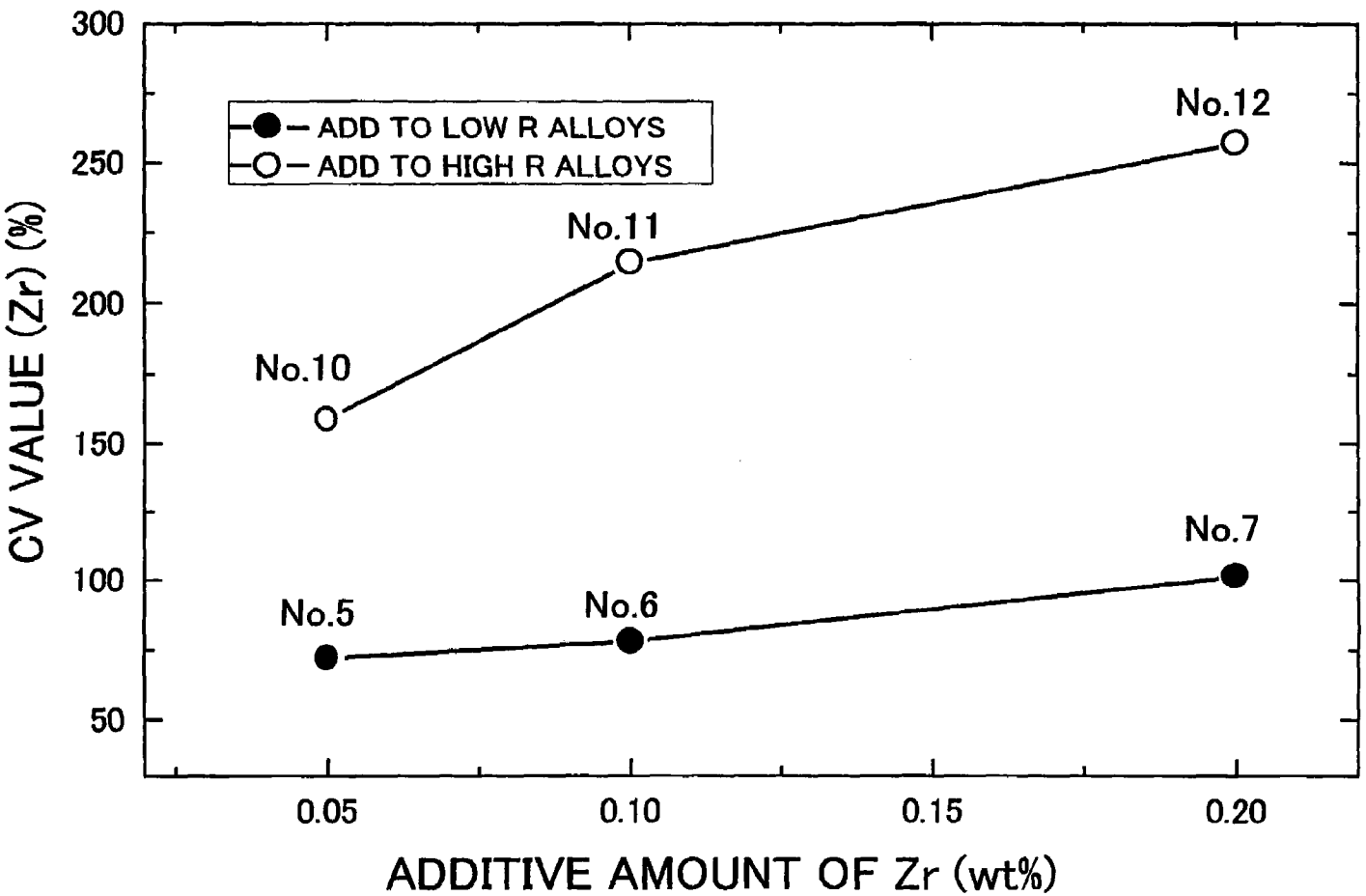
FIG. 8 is a graph showing the relationship between the method of adding Zr to permanent magnets obtained in Example 1 and the additive amount of Zr, and the CV (coefficient of variation) value of Zr.

From the results of the element mapping with EPMA of the permanent magnets Nos. 2 to 14 shown in FIG. 2, the dispersion of Zr was evaluated with a CV (coefficient of variation) value from the result of EPMA analysis. The CV value is a value (percentage) obtained by dividing the standard deviation of all analyzed points by the arithmetic mean value of all analyzed points. As this value is small, it shows that Zr has an excellent dispersion. Moreover, JCMA 733 (wherein PET (pentaerythritol) is used as an analyzing crystal) manufactured by Japan Electron Optics Laboratory Co., Ltd. was used as EPMA, and measurement conditions were determined as mentioned below. The results are shown in FIGS. 2 and 8. From FIGS. 2 and 8, it is found that the dispersion of Zr in the permanent magnets (Nos. 2 to 7) obtained by addition of Zr to low R alloys thereof is more excellent than that of the permanent magnets (Nos. 10 to 14) obtained by addition of Zr to high R alloys thereof.

Thus, the good dispersion of Zr, which can be obtained by adding it to a low R alloy is considered to inhibit the abnormal grain growth only with the addition of a small amount of Zr.

Acceleration voltage: 20 kV
Applied electric current: $1\times10^{-7}$ A
Applied time: 150 m sec/point
Measuring point: X→200 points (0.15 μm step) Y→200 points (0.146 μm step)
Scope: 30.0 μm×30.0 μm
Magnification: 2,000 times Example 2

Alloys a1, a2, a3 and b1 shown in FIG. 1 were mixed, so as to obtain the compositions of sintered bodies shown in FIG. 9. Thereafter, the obtained products were subjected to a hydrogen crushing treatment and then pulverized using a jet mill to a mean particle size of 4.0 μm. Thereafter, the fine powders were compacted in a magnetic field, and then sintered at 1,010° C. to 1,100° C. The obtained sintered bodies were subjected to a two-step aging treatment.

Figure 10:
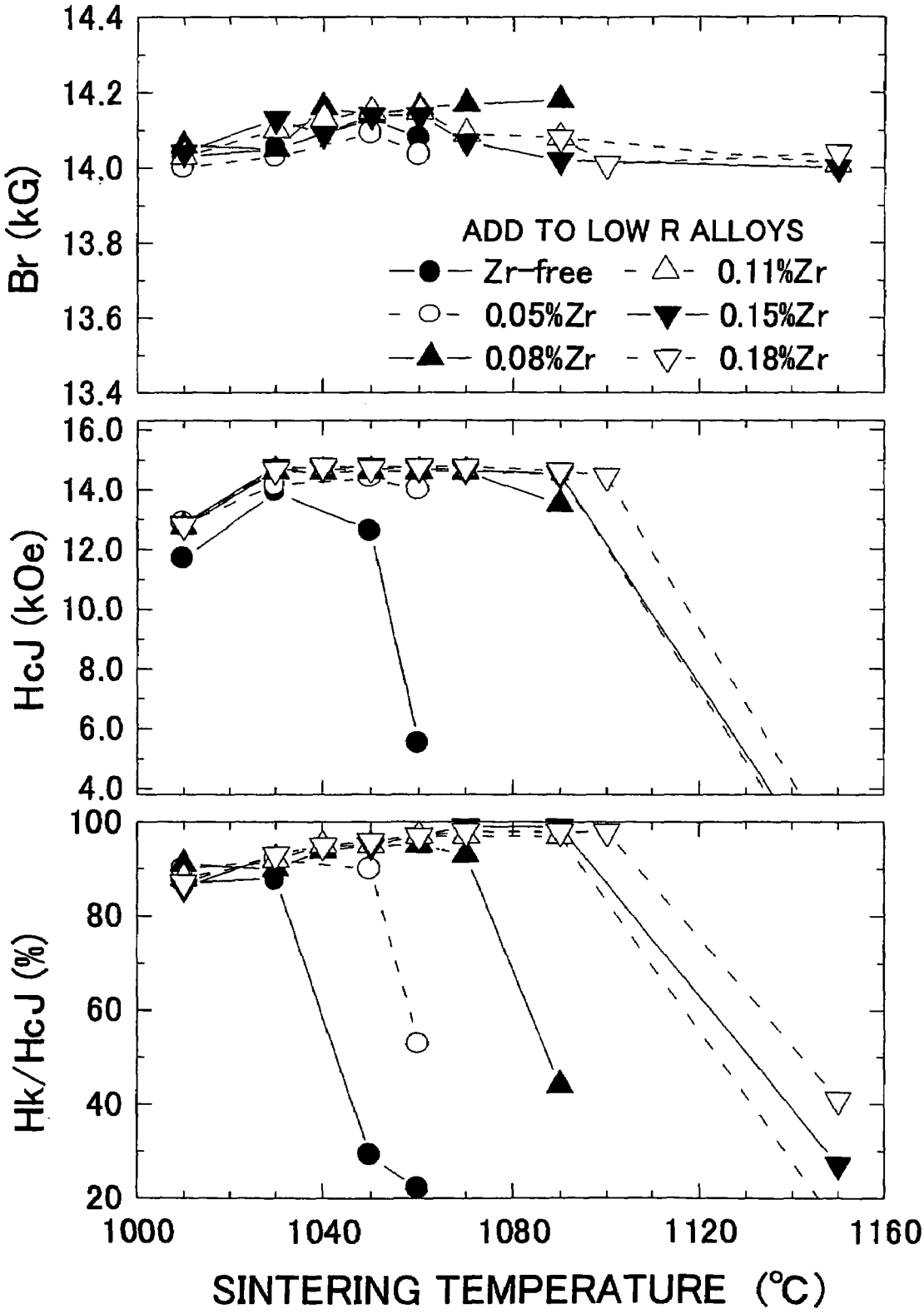
FIG. 10 is a set of graphs showing the relationship between each of the residual magnetic flux density (Br), coercive force (HcJ) and squareness (Hk/HcJ) of permanent magnets obtained in Example 2, and the additive amount of Zr.

The obtained R-T-B system rare earth permanent magnets were measured with a B-H tracer in terms of residual magnetic flux density (Br), coercive force (HcJ) and squareness (Hk/HcJ) In addition, the value Br+0.1×HcJ was also obtained, and the results are also shown in FIG. 9. Moreover, FIG. 10 is a set of graphs showing the relationship between each of the above magnetic properties and the sintering temperature.

In Example 2, in order to obtain higher magnetic properties, the content of oxygen in the sintered body was reduced to 600 to 900 ppm and the mean particle size of the pulverized powders was reduced to 4.0 μm by an oxygen free process. Thus, abnormal grain growth was likely to occur in a sintering process. Accordingly, other than the case of sintering at 1,030° C., the permanent magnets containing no Zr (Nos. 36 to 39 in FIG. 9, which are expressed as "Zr-free" in FIG. 10) had extremely low magnetic properties. Even in the case of sintering at 1,030° C., the squareness was 88%, and it did not reach 90%.

Among magnetic properties, the squareness (Hk/HcJ) tends to decrease most rapidly with the abnormal grain growth. This is to say, the squareness (Hk/HcJ) can be an indicator to grasp the inclination for the abnormal grain growth. Thus, when a zone of sintering temperatures in which 90% or more squareness (Hk/HcJ) could be obtained is defined as a "suitable sintering temperature range", permanent magnets containing no Zr have a suitable sintering temperature range of 0.

In contrast, permanent magnets obtained by addition of Zr to low R alloys thereof have a considerably wide suitable sintering temperature range. In the case of permanent magnets containing 0.05% Zr (FIG. 9, Nos. 40 to 43), 90% or more squareness (Hk/HcJ) can be obtained at the temperature range between 1,010° C. and 1,050° C. In other words, the suitable sintering temperature range of the permanent magnets containing 0.05% Zr is 40° C. Similarly, the suitable sintering temperature range of permanent magnets containing 0.08% Zr (FIG. 9, Nos. 44 to 50), permanent magnets containing 0.11% Zr (FIG. 9, Nos. 51 to 58) and permanent magnets containing 0.15% Zr (FIG. 9, Nos. 59 to 66) is 60° C. The suitable sintering temperature range of permanent magnets containing 0.18% Zr (FIG. 9, Nos. 67 to 75) is 70° C.

FIG. 11 is a set of photographs obtained by observing, by SEM (scanning electron microscope), the microstructure in the section of each of permanent magnets No. 37 (sintered at 1,030° C., containing no Zr), No. 39 (sintered at 1,060° C., containing no Zr), No. 43 (sintered at 1,060° C., containing 0.05% Zr) and No. 48 (sintered at 1,060° C., containing 0.08% Zr), all shown in FIG. 9. In addition, FIG. 12 shows the 4 πI-H curve of each of the permanent magnets obtained in Example 2.

As in the case of No. 37, if no Zr is added, the abnormal grain growth is likely to occur, and as shown in FIG. 11 somewhat coarse grains are observed. As in the case of No. 39, if the sintering temperature is such high as 1,060° C., the abnormal grain growth is remarkably observed. As shown in FIG. 11, coarse crystal grains having a grain diameter of 100 μm or greater are remarkably deposited. In the case of No. 43 to which 0.05% of Zr was added, as shown in FIG. 11, the number of generated coarse crystal grains can be reduced. In the case of No. 48 to which 0.08% of Zr was added, as shown in FIG. 11, even though it was sintered at 1,060° C., a fine and uniform microstructure could be obtained, and no coarse crystal grains caused by abnormal grain growth was observed. In the microstructure, no coarse crystal grains with a grain diameter of 100 μm or greater were observed.

Figure 12:
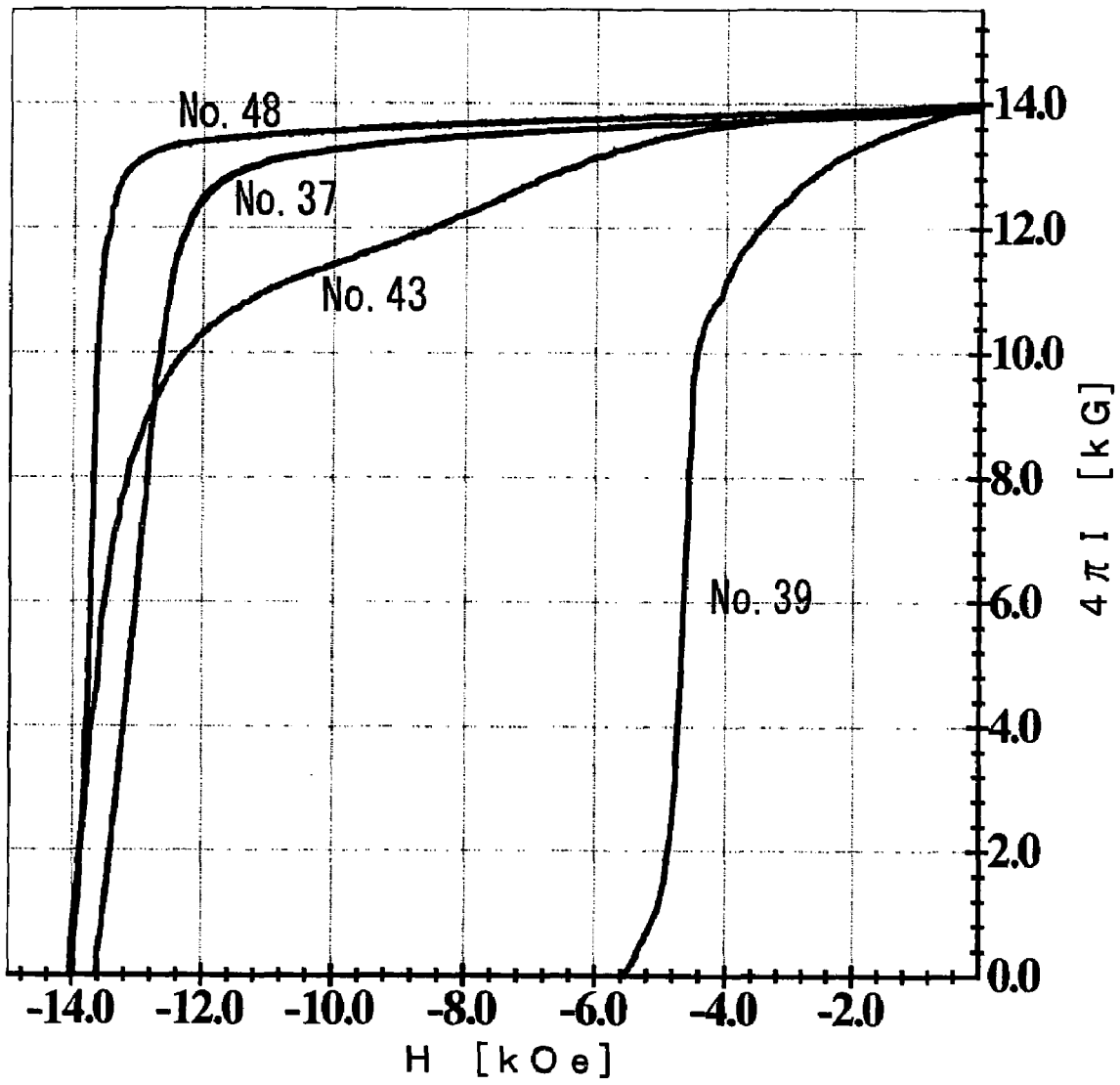
FIG. 12 is a graph showing the 4 πI-H curve of each of the permanent magnets Nos. 37, 39, 43 and 48 obtained in Example 2.

Referring to FIG. 12, in contrast to No. 48 with a fine and uniform microstructure, if coarse crystal grains with a grain diameter of 100 μm or greater are generated as in the case of No. 43, the squareness (Hk/HcJ) decreases first. The decreases in the residual magnetic flux density (Br) and the coercive force (HcJ) are not found at this stage. As shown in No. 39, as the abnormal grain growth progresses and thereby coarse crystal grains with a grain diameter of 100 μm or greater increase, the squareness (Hk/HcJ) significantly deteriorates, and the coercive force (HcJ) decreases. However, the decrease of the residual magnetic flux density (Br) does not start yet.

Figure 13:
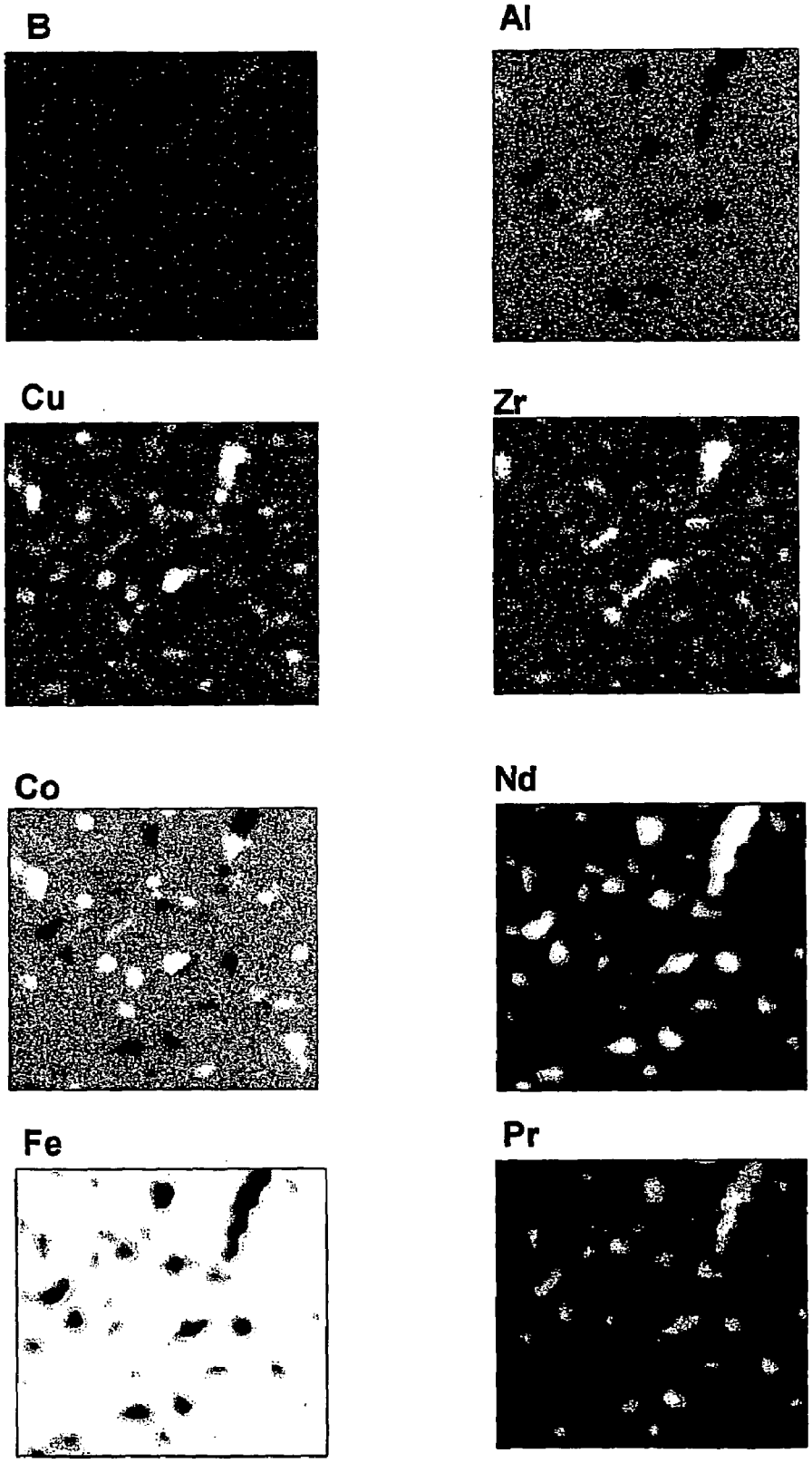
FIG. 13 is a set of photographs showing the mapping image (30 μm×30 μm) of each of elements B, Al, Cu, Zr, Co, Nd, Fe and Pr of the permanent magnet No. 70 obtained in Example 2.
Figure 14:
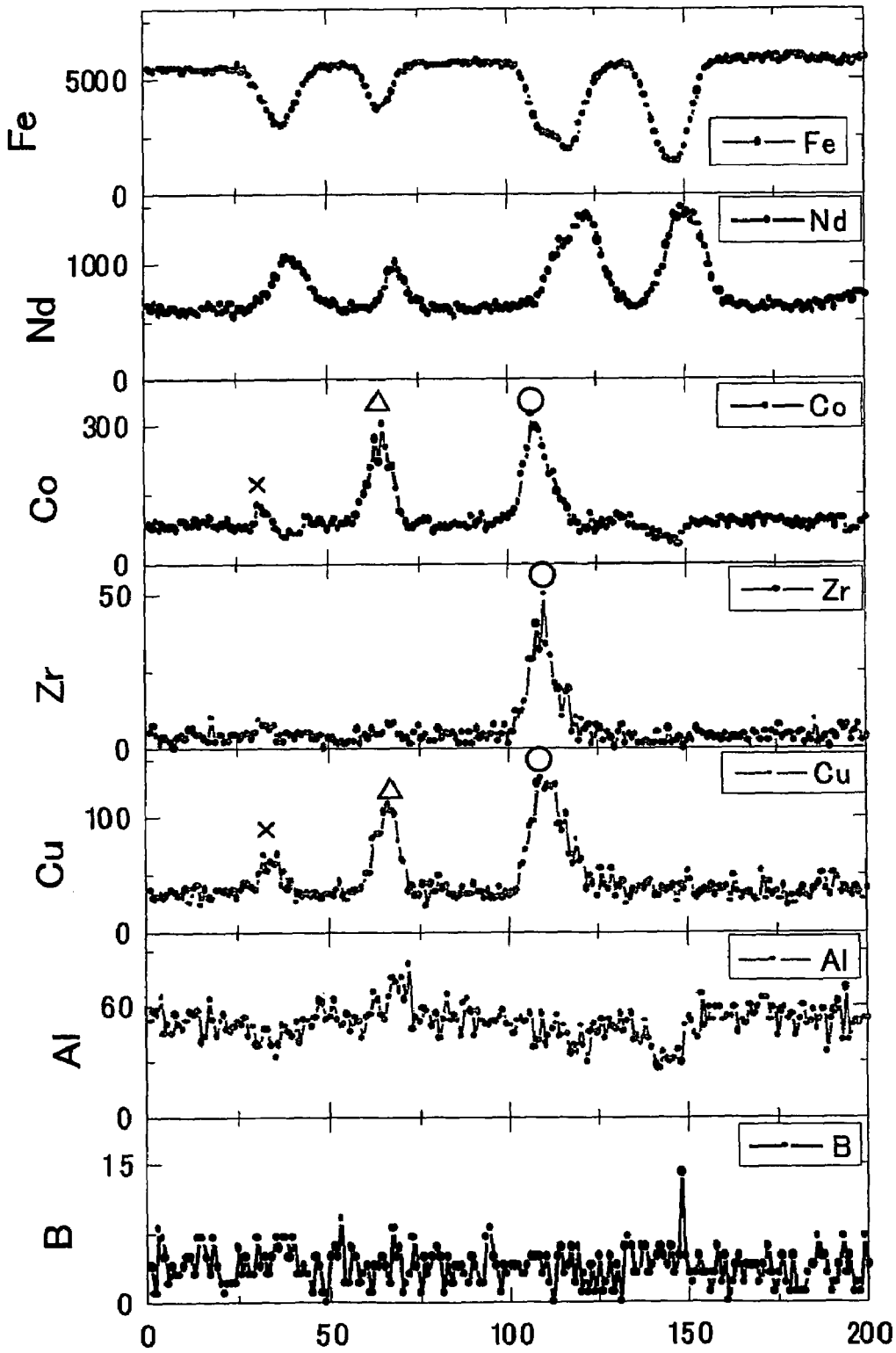
FIG. 14 is one profile of EPMA line analysis of the permanent magnet No. 70 obtained in Example 2.
Figure 15:
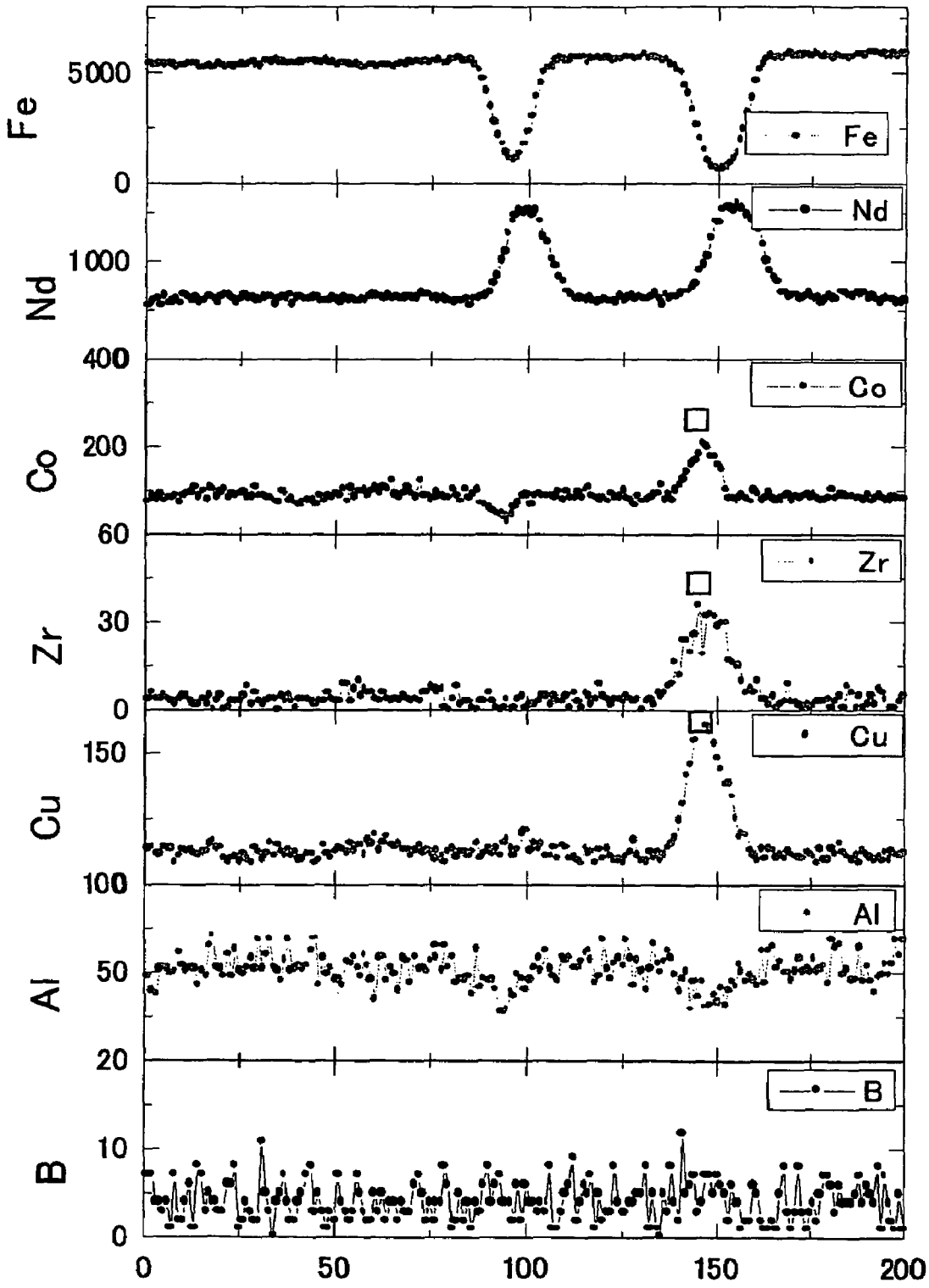
FIG. 15 is the other profile of EPMA line analysis of the permanent magnet No. 70 obtained in Example 2.

The CV value of each of the permanent magnets Nos. 51 to 66 shown in FIG. 9 was measured. The results are shown in FIG. 9. In a sintering temperature range (1,030° C. to 1,090° C.) wherein 90% or more squareness (Hk/HcJ) can be obtained, the CV value is 100 or less, and the dispersion of Zr is good. However, when the sintering temperature increases to 1,150° C., the CV value exceeds 130, which is defined in the present invention. Next, the permanent magnet No. 70 shown in FIG. 9 was analyzed by EPMA. FIG. 13 shows the mapping image (30 μm×30 μm) of each of elements B, Al, Cu, Zr, Co, Nd, Fe and Pr of the permanent magnet No. 70. A line analysis was carried out on each of the above elements in the area of the mapping image shown in FIG. 13. The line analysis was carried out based on two different lines. FIG. 14 shows one line analysis profile, and FIG. 15 shows the other line analysis profile.

As shown in FIG. 14, there are positions where the peak positions of Zr, Co and Cu are the same (open circle (○)) and positions where the peak positions of Zr and Cu are the same (triangle (Δ), cross (X)). Moreover, in FIG. 15 also, there are observed the positions where the peak positions of Zr, Co and Cu are the same (rectangular(□)). Thus, a region that is rich in Zr is also rich in Co and/or Cu. Since this Zr rich region overlaps with a region that is rich in Nd but is poor in Fe, it is found that Zr exists in the grain boundary phase in a permanent magnet.

As described above, the permanent magnet No. 70 generates a grain boundary phase that is rich both in one or more types of Co, Cu and Nd, and in Zr. The evidence that Zr and B formed a compound could not be found.

Based on the EPMA analysis, the frequency that the region that is rich in Cu, Co and Nd is identical to the region that is rich in Zr was obtained. As a result, it was found that the region that is rich in Cu is identical to the region that is rich in Zr with a probability of 94%. Likewise, a probability in the case of Co and Zr was 65.3%, and that of the case of Nd and Zr was 59.2%.

Figure 16:
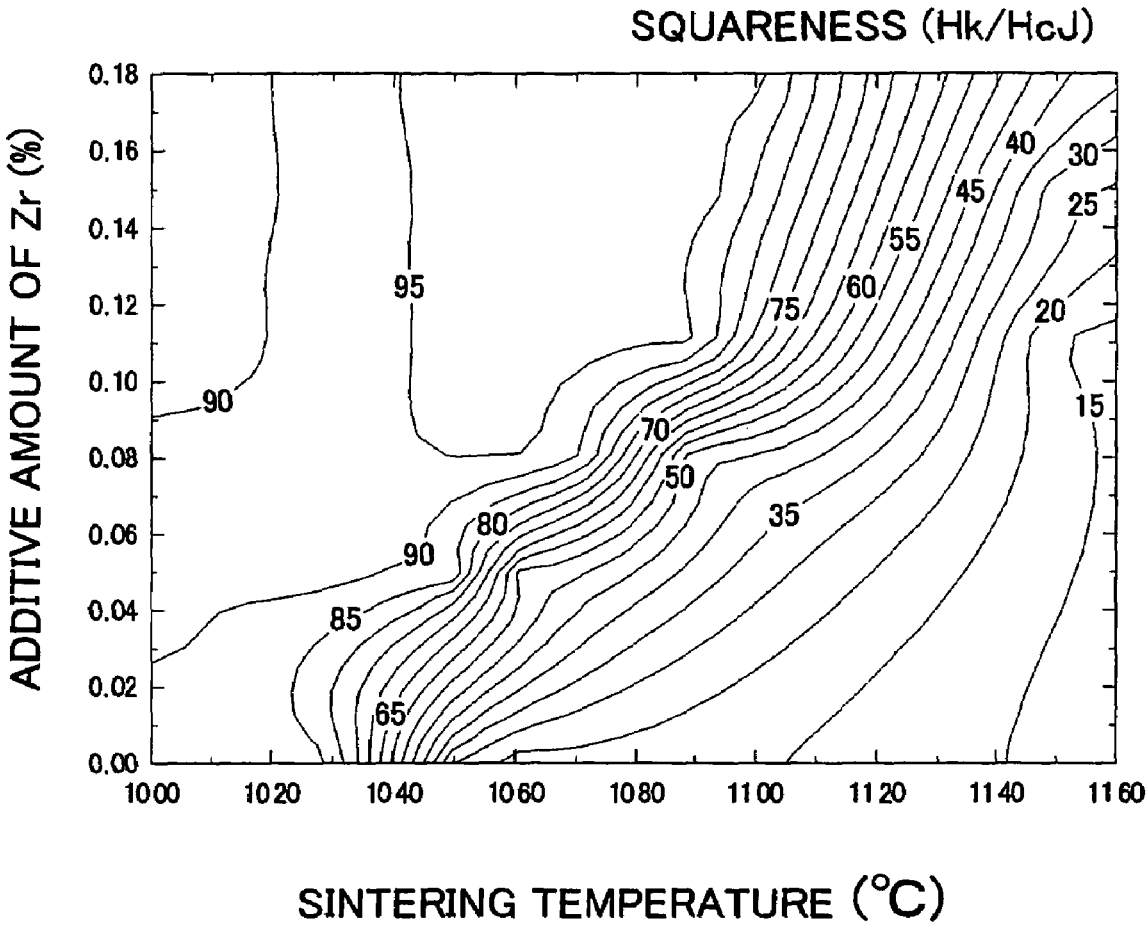
FIG. 16 is a graph showing the relationship among the additive amount of Zr, the sintering temperature, and squareness (Hk/HcJ), in the permanent magnets obtained in Example 2.

FIG. 16 is a graph showing the relationship among the additive amount of Zr, the sintering temperature, and the squareness (Hk/HcJ) in Example 2.

From FIG. 16, it is found that 0.03% or more Zr needs to be added in order to extend the suitable sintering temperature range and to obtain 90% or more squareness (Hk/HcJ) It is also found that 0.08% or more Zr needs to be added in order to obtain 95% or more squareness (Hk/HcJ).

Example 3

R-T-B system rare earth permanent magnets were obtained by the same process as in Example 2, with the exception that alloys a1 to a4 and b1 shown in FIG. 1 were mixed to obtain the compositions of magnets shown in FIG. 17. These permanent magnets contain 1,000 ppm or less oxygen. When the microstructure of sintered bodies was observed, no coarse crystal grains with a grain diameter of 100 μm or greater were found. The residual magnetic flux density (Br), coercive force (HcJ) and squareness (Hk/HcJ) of these permanent magnets were measured with a B-H tracer in the same manner as in Example 1. In addition, the value Br+0.1×HcJ was also obtained. The results are shown in FIG. 17.

One purpose for carrying out Example 3 was confirmation of the change of magnetic properties depending on the amount of Dy. From FIG. 17, it is found that the coercive force (HcJ) increases as the amount of Dy increases. At the same time, all the permanent magnets have a Br+0.1×HcJ value of 15.4 or greater. This shows that the permanent magnet of the present invention can achieve a high level of residual magnetic flux density (Br), while maintaining a certain coercive force (HcJ)

Example 4

R-T-B system rare earth permanent magnets were obtained by the same process as in Example 2, with the exception that alloys a7, a8, b4 and b5 shown in FIG. 1 were mixed to obtain the compositions of sintered bodies shown in FIG. 18. The permanent magnet No. 80 in FIG. 18 was obtained by mixing the alloy a7 with the alloy b4 at a weight ratio of 90:10, and the permanent magnet No. 81 in the same figure was obtained by mixing the alloy a8 with the alloy b5 at a weight ratio of 80:20. The mean particle size of powders was 4.0 μm after pulverizing. As shown in FIG. 18, the amount of oxygen contained in the obtained permanent magnets was 1,000 ppm or less. When the microstructure of sintered bodies was observed, no coarse crystal grains with a grain diameter of 100 μm or greater were found. The residual magnetic flux density (Br), coercive force (HcJ) and squareness (Hk/HcJ) of these permanent magnets were measured with a B-H tracer in the same manner as in Example 1. In addition, the value Br+0.1×HcJ was also obtained. Furthermore, the CV value was obtained. The results are shown in FIG. 18.

As shown in FIG. 18, even when the content of constitutional elements were changed from Examples 1, 2 and 3, a high level of residual magnetic flux density (Br) could be obtained, while maintaining a certain coercive force (HcJ)

INDUSTRIAL APPLICABILITY

As described in detail above, the abnormal grain growth occurring during sintering can be inhibited by the addition of Zr. Thus, even when processes such as the reduction of the amount of oxygen are adopted, the decrease in a squareness can be inhibited. In particular, according to the present invention, since Zr can be present in a sintered body with good dispersion, the amount of Zr used to inhibit the abnormal grain growth can be reduced. Accordingly, the deterioration of other magnetic properties such as a residual magnetic flux density can be kept to a minimum. Moreover, according to the present invention, since a suitable sintering temperature range of 40° C. or more can be kept, even using a large sintering furnace that is usually likely to cause unevenness in heating temperature, an R-T-B system rare earth permanent magnet consistently having high magnetic properties can be easily obtained.

What is claimed is:

1. A method for manufacturing an R-T-B system rare earth permanent magnet comprising a sintered body with a composition consisting essentially of 25% to 35% by weight of R (wherein R represents one or more rare earth elements, providing that the rare earth elements include Y), 0.5% to 4.5% by weight of B, 0.02% to 0.6% by weight of Al and/or Cu, 0.03% to 0.25% by weight of Zr, 4% or less by weight (excluding 0) of Co, and the balance substantially being Fe, said manufacturing method comprising the steps of:

manufacturing a compacted body containing a low R alloy containing a $R_2T_{14}B$ compound as a main constituent and Zr, and a high R alloy containing, as main constituents, R and T (wherein T represents at least one transition metal element essentially containing Fe, or Fe and Co), wherein said high R alloy contains a higher amount of R than said low R alloy; and sintering the compacted body.

2. A method for manufacturing an R-T-B system rare earth permanent magnet according to claim 1, wherein said low R alloy contains Cu and/or Al as well as Zr.

3. A method for manufacturing an R-T-B system rare earth permanent magnet according to claim 1, wherein a suitable sintering temperature range is 40° C. or more in order that said R-T-B system rare earth permanent magnet has squareness (Hk/HcJ) of 90% or more.

4. A method for manufacturing an R-T-B system rare earth permanent magnet according to claim 1, wherein the content of Zr in said sintered body is between 0.05% and 0.2% by weight.

5. A method for manufacturing an R-T-B system rare earth permanent magnet according to claim 1, wherein the content of Zr in said sintered body is 0.1% to 0.15% by weight.

6. A method for manufacturing an R-T-B system rare earth permanent magnet according to claim 1, wherein the amount of oxygen contained in said body is 2,000 ppm or less.

* * * * *